US010136698B2

(12) United States Patent
Granger et al.

(10) Patent No.: US 10,136,698 B2
(45) Date of Patent: Nov. 27, 2018

(54) SHOE INSOLE

(71) Applicant: Implus Footcare, LLC, Durham, NC (US)

(72) Inventors: David Bradley Granger, Lorena, TX (US); Jacob Martinez, Temple, TX (US)

(73) Assignee: IMPLUS FOOTCARE, LLC, Durham, NC (US)

( * ) Notice: Subject to any disclaimer, the term of this patent is extended or adjusted under 35 U.S.C. 154(b) by 0 days.

(21) Appl. No.: 15/570,550

(22) PCT Filed: Apr. 21, 2016

(86) PCT No.: PCT/US2016/028685
§ 371 (c)(1),
(2) Date: Oct. 30, 2017

(87) PCT Pub. No.: WO2016/190998
PCT Pub. Date: Dec. 1, 2016

(65) Prior Publication Data

US 2018/0140040 A1 May 24, 2018

Related U.S. Application Data

(60) Provisional application No. 62/167,791, filed on May 28, 2015, provisional application No. 62/182,103, (Continued)

(51) Int. Cl.
*A43B 7/14* (2006.01)

(52) U.S. Cl.
CPC ..... *A43B 7/141* (2013.01); *A43B 7/143* (2013.01); *A43B 7/144* (2013.01); *A43B 7/145* (2013.01);
(Continued)

(58) Field of Classification Search
CPC ..... A43B 7/141; A43B 7/142; A43B 7/144; A43B 7/1445; A43B 17/00; A43B 17/02
(Continued)

(56) References Cited

U.S. PATENT DOCUMENTS 333,595 A 1/1886 Butterfield
360,127 A 3/1887 Wallis
(Continued)

FOREIGN PATENT DOCUMENTS

DE 2603716 12/1976
EP 0774219 12/1997
(Continued)

OTHER PUBLICATIONS

[online] [retrieved on Jan. 22, 2013] [retrieved from Foot Science Limited website] (pdf) http://www.footscience.com/products_foot.html.
(Continued)

*Primary Examiner* — Ted Kavanaugh
(74) *Attorney, Agent, or Firm* — Buchanan Ingersoll & Rooney PC

(57) ABSTRACT

An insole providing cushioning and control of foot motion. The insole includes a stability cradle and an extended heel pad secured to the underside of the base of the insole. A supplemental heel pad is also attached to lay over a portion of the extended heel pad. The extended heel pad and supplemental heel pad are constructed of materials to help control foot pronation.

30 Claims, 8 Drawing Sheets

Related U.S. Application Data filed on Jun. 19, 2015, provisional application No. 62/213,037, filed on Sep. 1, 2015.

(52) U.S. Cl.
CPC ..... *A43B 7/1425* (2013.01); *A43B 7/1435* (2013.01); *A43B 7/1445* (2013.01)

(58) Field of Classification Search
USPC ..... 36/43, 44
See application file for complete search history.

(56) References Cited

U.S. PATENT DOCUMENTS 892,360 A 6/1908 Burns
1,559,324 A 10/1925 Jensen
1,688,642 A 10/1928 Mattison
1,693,122 A 11/1928 Schwartz
1,718,906 A 6/1929 Hurley
1,811,641 A 6/1931 Marcelle
1,861,969 A 6/1932 Leighton, Jr.
1,920,112 A 7/1933 Shaft
1,945,780 A 2/1934 Johnson
2,031,510 A 2/1936 Stewart et al.
2,045,844 A 6/1936 Everston
2,055,574 A 9/1936 Hartl
2,090,881 A 8/1937 Wilson
2,207,437 A 7/1940 Marks et al.
2,224,590 A 12/1940 Boivin
2,224,642 A 12/1940 Burns
2,284,947 A 6/1942 Clifford
2,302,706 A 11/1942 Margolin
2,347,207 A 4/1944 Margolin
2,408,564 A 10/1946 Lea
D149,889 S 6/1948 Laybolt
2,502,774 A 4/1950 Alianiello
2,553,616 A 5/1951 Walls
2,790,254 A 4/1957 Burns
2,827,050 A 3/1958 Fisher
2,857,689 A 10/1958 Van Ostrom et al.
2,863,231 A * 12/1958 Jones ..... A43B 7/14 36/174
2,985,971 A 5/1961 Murawski
3,084,695 A 4/1963 O'Donnell
3,154,867 A 11/1964 Strope
3,475,836 A 11/1969 Brahm
3,992,801 A 11/1976 McDiarmid et al.
D243,642 S 3/1977 Voorhees
4,020,570 A 5/1977 Shames
4,033,054 A 7/1977 Fukuoka
D246,486 S 11/1977 Nickel
4,071,963 A 2/1978 Fukuoka
4,108,928 A 8/1978 Swan, Jr.
4,123,855 A 11/1978 Thedford
4,139,337 A 2/1979 David et al.
4,150,455 A 4/1979 Fukuoka
4,179,826 A 12/1979 Davidson
4,215,492 A 8/1980 Sandmeier
4,219,945 A 9/1980 Rudy
4,223,457 A 9/1980 Borgeas
4,229,546 A 10/1980 Swan, Jr.
4,237,626 A 12/1980 Brown
4,263,728 A 4/1981 Frecentese
4,309,831 A 1/1982 Pritt
4,316,332 A 2/1982 Giese et al.
4,325,380 A 4/1982 Malkin
4,346,205 A 8/1982 Hiles
4,346,525 A 8/1982 Larsen et al.
4,364,188 A 12/1982 Turner et al.
4,408,402 A 10/1983 Looney
4,413,429 A 11/1983 Power
4,453,322 A 6/1984 Marsh
4,541,184 A 9/1985 Leighton
4,541,186 A 9/1985 Mulvihill
4,546,555 A 10/1985 Spademan
4,557,060 A 12/1985 Kawashima
4,571,857 A 2/1986 Castellanos
4,581,187 A 4/1986 Sullivan et al.
4,584,782 A 4/1986 Thatcher
4,616,430 A 10/1986 McQuiggin
4,619,056 A 10/1986 Lin et al.
4,627,178 A 12/1986 Sullivan et al.
4,627,179 A 12/1986 McElroy
4,633,597 A 1/1987 Shiang
4,633,598 A 1/1987 Moronaga et al.
4,633,877 A 1/1987 Pendergast
D288,383 S 2/1987 Autry
4,674,204 A 6/1987 Sullivan et al.
4,694,589 A 9/1987 Sullivan et al.
4,694,831 A 9/1987 Seltzer
4,729,179 A 3/1988 Quist, Jr.
D295,690 S 5/1988 Finn
D299,583 S 1/1989 Tong et al.
4,800,657 A 1/1989 Brown
4,808,469 A 2/1989 Hiles
4,813,160 A 3/1989 Kuznetz
4,860,463 A 8/1989 Pin
4,864,736 A 9/1989 Bierk
4,864,740 A 9/1989 Oakley
4,876,758 A 10/1989 Rolloff et al.
4,887,368 A 12/1989 Latzke
4,888,841 A 12/1989 Cumberland
4,888,887 A 12/1989 Solow
4,928,404 A 5/1990 Scheuermann
D311,269 S 10/1990 Graham et al.
4,974,342 A 12/1990 Nakamura
5,010,661 A 4/1991 Chu
5,014,706 A 5/1991 Philipp
5,025,573 A 6/1991 Giese et al.
5,025,575 A 6/1991 Lakic
5,027,461 A 7/1991 Cumberland
5,035,068 A 7/1991 Biasi
D319,919 S 9/1991 Niarhos
D324,761 S 3/1992 Soo-Kwan
5,092,060 A 3/1992 Frachey et al.
5,138,775 A 4/1992 Chu
5,155,927 A 10/1992 Bates et al.
5,175,946 A 1/1993 Tsai
5,184,409 A 2/1993 Brown
5,197,207 A 3/1993 Shorten
5,201,125 A 4/1993 Shorten
D336,718 S 6/1993 Schroer, Jr.
5,224,277 A 7/1993 Sang Do
5,233,767 A 8/1993 Kramer
D342,374 S 12/1993 Wang
5,282,324 A 2/1994 Cheng
D346,480 S 5/1994 Davidson
D348,146 S 6/1994 Nakano
D349,393 S 8/1994 Mishan
D350,432 S 9/1994 Saez
D350,848 S 9/1994 Tzenos
5,363,570 A 11/1994 Allen et al.
5,367,791 A 11/1994 Gross et al.
D353,710 S 12/1994 Brazzell
5,369,896 A 12/1994 Frachey et al.
5,375,346 A 12/1994 Cole et al.
5,400,528 A 3/1995 Skinner et al.
5,400,526 A 4/1995 Sessa
5,408,761 A 4/1995 Gazzano
5,430,960 A 7/1995 Richardson
5,438,768 A 8/1995 Bauerfeind
5,443,529 A 8/1995 Phillips
5,467,536 A 11/1995 Ramer et al.
5,493,791 A 2/1996 Kramer
D367,953 S 3/1996 King
5,509,938 A 4/1996 Phillips
5,524,364 A 6/1996 Cole et al.
5,545,463 A 8/1996 Schmidt et al.
D374,549 S 10/1996 McDonald
5,615,496 A 4/1997 Sharpstein
5,619,809 A 4/1997 Sessa
5,640,779 A 6/1997 Rolloff et al.
D380,290 S 7/1997 Nakagawa
D383,894 S 9/1997 Snyder et al.

(56) References Cited

U.S. PATENT DOCUMENTS 5,669,162 A 9/1997 Dyer
D384,797 S 10/1997 Nakagawa
5,675,914 A 10/1997 Cintron
5,678,328 A 10/1997 Schmidt et al.
5,685,094 A 11/1997 Lin
D388,947 S 1/1998 Sessa
D389,296 S 1/1998 Sessa
D389,996 S 2/1998 Sessa
5,714,098 A 2/1998 Potter
5,722,186 A 3/1998 Brown
5,732,481 A 3/1998 Farhad
5,768,801 A 6/1998 Huff
5,771,606 A 6/1998 Litchfield et al.
5,775,005 A 7/1998 McClelland
D396,948 S 8/1998 Moore et al.
5,802,737 A 9/1998 Beppu
D399,042 S 10/1998 Strawser et al.
5,815,949 A 10/1998 Sessa
5,845,418 A 12/1998 Chi
5,846,063 A 12/1998 Lakic
5,852,885 A 12/1998 Ferniani
D403,847 S 1/1999 Blythe
5,879,725 A 3/1999 Potter
D411,759 S 7/1999 Byrd
D418,666 S 1/2000 Brown
D420,210 S 2/2000 Allen
D420,788 S 2/2000 Kitagawa
6,029,372 A 2/2000 Pan
D423,765 S 5/2000 Autry
D425,690 S 5/2000 Bray et al.
D426,118 S 6/2000 Thomas
6,070,342 A 6/2000 Brown
6,079,123 A 6/2000 Clark
6,082,023 A 7/2000 Dalton
D428,689 S 8/2000 Guiotto et al.
D429,063 S 8/2000 Rose
6,105,283 A 8/2000 Park
D432,769 S 10/2000 Yung et al.
6,151,801 A 11/2000 Frederiksen et al.
6,176,025 B1 1/2001 Patterson et al.
D441,947 S 5/2001 Escobar et al.
6,233,847 B1 5/2001 Brown
6,266,897 B1 7/2001 Seydel et al.
D448,542 S 10/2001 Bryant
D448,850 S 10/2001 Fabricant
6,301,805 B1 10/2001 Howlett et al.
D456,128 S 4/2002 Evans et al.
D460,854 S 7/2002 Hung
6,425,195 B1 7/2002 Donzis
6,453,578 B1 9/2002 Yung et al.
D465,079 S 11/2002 Merceron
6,481,120 B1 11/2002 Xia et al.
6,497,057 B1 12/2002 Lee et al.
6,502,330 B1 1/2003 David et al.
6,510,626 B1 1/2003 Greenawalt
6,519,874 B1 2/2003 Dean
D471,001 S 3/2003 Beck
6,536,137 B1 3/2003 Celia
6,553,690 B2 4/2003 Di Girolamo
D474,331 S 5/2003 Dean
D474,588 S 5/2003 Dean
D474,881 S 5/2003 Su
D475,844 S 6/2003 Reynolds et al.
6,581,303 B1 6/2003 Tuan
6,598,319 B2 7/2003 Hardt
6,618,960 B2 9/2003 Brown
6,631,568 B2 10/2003 Howlett et al.
D485,425 S 1/2004 Polifroni
D485,426 S 1/2004 Di Girolamo
6,671,979 B2 1/2004 Cardarelli
6,684,532 B2 2/2004 Greene et al.
D489,520 S 5/2004 Matis et al.
D495,123 S 8/2004 Wakatake
D497,473 S 10/2004 Martinez
D497,708 S 11/2004 Granger et al.
6,817,115 B2 11/2004 Polifioni
D500,914 S 1/2005 Ammon
6,880,266 B2 4/2005 Schoenborn et al.
6,915,598 B2 7/2005 Grisoni et al.
6,959,505 B2 11/2005 Poe
6,967,044 B1 11/2005 O'Brien
D515,292 S 2/2006 Granger et al.
7,082,702 B2 8/2006 Cretinon
7,082,704 B2 8/2006 Throneburg
7,107,705 B2 9/2006 Dalton et al.
D529,691 S 10/2006 Earle
D543,685 S 6/2007 Andersen et al.
7,284,342 B2 10/2007 Avent et al.
7,316,081 B1 1/2008 Cheng
D563,649 S 3/2008 Andersen et al.
D576,391 S 9/2008 Contreras
D576,394 S 9/2008 Heller
7,437,836 B2 10/2008 Kim
D584,885 S 1/2009 Contreras
7,484,319 B2 2/2009 Cheskin et al.
D592,386 S 5/2009 Baker et al.
D593,742 S 6/2009 Issler
D594,640 S 6/2009 McMillan
D596,833 S 7/2009 Dominquez et al.
7,555,849 B2 7/2009 Canvin
D602,238 S 10/2009 Avent et al.
7,610,696 B2 11/2009 Davis
7,665,169 B2 2/2010 Cheskin et al.
D611,237 S 3/2010 Torrance et al.
7,712,229 B2 5/2010 Yang
7,721,467 B2 5/2010 Cheskin et al.
D617,086 S 6/2010 Avent et al.
D617,087 S 6/2010 Avent et al.
D627,958 S 11/2010 Cheskin et al.
D628,779 S 12/2010 Martinez et al.
D634,920 S 3/2011 Martinez et al.
D634,924 S 3/2011 Cheskin et al.
7,900,380 B2 3/2011 Rich
7,908,768 B2 3/2011 Cheskin et al.
8,136,266 B2 3/2012 McCarron
D656,716 S 4/2012 Eades
8,186,081 B2 5/2012 Wilson, III et al.
D663,511 S 7/2012 Martinez et al.
8,241,450 B2 8/2012 Hensley et al.
8,250,784 B2 8/2012 Cheskin et al.
8,296,969 B2 10/2012 Granger et al.
8,424,222 B2 4/2013 Sulak et al.
D681,321 S 5/2013 Martinez et al.
8,745,894 B2 6/2014 Cheskin et al.
8,800,168 B1 * 8/2014 Propet ..... A43B 7/141 36/173
D723,786 S 3/2015 Martinez et al.
9,788,602 B2 * 10/2017 Wynn ..... A43B 13/383
2001/0000369 A1 4/2001 Snyder et al.
2001/0045028 A1 11/2001 Crane et al.
2002/0050080 A1 5/2002 Vasyli
2002/0092203 A1 7/2002 Hardt
2002/0116840 A1 8/2002 Kraft
2003/0009915 A1 1/2003 Bacon
2003/0024134 A1 2/2003 Howlett et al.
2003/0070321 A1 4/2003 Davis et al.
2003/0093920 A1 5/2003 Greene et al.
2003/0121180 A1 7/2003 Poe
2003/0136025 A1 7/2003 Galbraith et al.
2003/0150134 A1 8/2003 Hardt
2004/0020075 A1 2/2004 Garneau
2004/0025374 A1 2/2004 Basso
2004/0118017 A1 6/2004 Dalton et al.
2004/0181971 A1 9/2004 Turkbas et al.
2004/0194344 A1 10/2004 Tadin
2005/0138847 A1 6/2005 Blackburn et al.
2005/0166425 A1 8/2005 Seiter
2005/0262736 A1 12/2005 Peoples
2006/0010717 A1 1/2006 Finkelstein
2006/0016099 A1 1/2006 Marco et al.
2006/0026779 A1 2/2006 Berg et al.
2006/0026865 A1 2/2006 Grisoni et al.
2006/0096124 A1 5/2006 Moseley

(56) References Cited

U.S. PATENT DOCUMENTS

| | | | | |
|---|---|---|---|---|
| 2006/0123664 | A1* | 6/2006 | Boyd | A43B 7/1425 36/44 |
| 2006/0130367 | A1 | 6/2006 | Liu | |
| 2006/0137216 | A1 | 6/2006 | Ahlbaumer | |
| 2006/0168846 | A1 | 8/2006 | Juan | |
| 2006/0230643 | A1 | 10/2006 | Affleck | |
| 2006/0254088 | A1 | 10/2006 | McCormick | |
| 2006/0283043 | A1 | 12/2006 | Lamstein | |
| 2007/0022630 | A1 | 2/2007 | Lundy, Jr. et al. | |
| 2007/0033834 | A1* | 2/2007 | Cheskin | A43B 7/141 36/44 |
| 2007/0039209 | A1 | 2/2007 | White | |
| 2007/0084084 | A1 | 4/2007 | Rich | |
| 2007/0245592 | A1 | 10/2007 | Yamaguchi et al. | |
| 2007/0261268 | A1 | 11/2007 | Nguyen | |
| 2008/0028637 | A1 | 2/2008 | Benfatti | |
| 2008/0110060 | A1 | 5/2008 | Ritter | |
| 2008/0110064 | A1 | 5/2008 | Liu | |
| 2008/0271340 | A1 | 11/2008 | Grisoni et al. | |
| 2008/0295358 | A1 | 12/2008 | Lin et al. | |
| 2009/0025254 | A1 | 1/2009 | Smith | |
| 2009/0049712 | A1* | 2/2009 | Steszyn | A43B 7/142 36/91 |
| 2009/0100722 | A1 | 4/2009 | Hoffer et al. | |
| 2009/0151194 | A1 | 6/2009 | Cheskin et al. | |
| 2009/0165334 | A1 | 7/2009 | Kantro et al. | |
| 2009/0249650 | A1 | 10/2009 | Sarantakos | |
| 2010/0015869 | A1 | 1/2010 | Hartmann et al. | |
| 2010/0083534 | A1 | 4/2010 | Howlett | |
| 2010/0095552 | A1 | 4/2010 | Cheskin et al. | |
| 2010/0126044 | A1 | 5/2010 | Davis | |
| 2010/0170116 | A1 | 7/2010 | Shim | |
| 2010/0205831 | A1* | 8/2010 | Cheskin | A43B 1/0009 36/44 |
| 2010/0212187 | A1 | 8/2010 | Jones | |
| 2010/0218398 | A1 | 9/2010 | Reinhardt et al. | |
| 2010/0218399 | A1 | 9/2010 | Jeong | |
| 2010/0251577 | A1 | 10/2010 | Yamada | |
| 2010/0269371 | A1 | 10/2010 | Gray | |
| 2011/0041360 | A1 | 2/2011 | Torrance | |
| 2011/0072685 | A1 | 3/2011 | Gutowsky, Jr. et al. | |
| 2011/0131835 | A1 | 6/2011 | Cheskin | |
| 2011/0162234 | A1 | 7/2011 | Dean | |
| 2011/0209360 | A1 | 9/2011 | Baker et al. | |
| 2011/0219642 | A1 | 9/2011 | Sulak et al. | |
| 2011/0232129 | A1 | 9/2011 | Roberts et al. | |
| 2011/0252665 | A1 | 10/2011 | Tsai | |
| 2011/0252671 | A1 | 10/2011 | Maron et al. | |
| 2011/0302805 | A1 | 12/2011 | Vito | |
| 2012/0023776 | A1* | 2/2012 | Skaja | A43B 7/1425 36/44 |
| 2012/0090197 | A1 | 4/2012 | Wyner et al. | |
| 2012/0192452 | A1 | 8/2012 | Lewis et al. | |
| 2012/0272546 | A1 | 11/2012 | Tsai | |
| 2013/0008050 | A1 | 1/2013 | Marc | |
| 2013/0025156 | A1* | 1/2013 | Martinez | A43B 7/141 36/43 |
| 2013/0104419 | A1 | 5/2013 | Horesh et al. | |
| 2013/0160331 | A1 | 6/2013 | Burke | |
| 2015/0201702 | A1* | 7/2015 | Paul | A43B 17/02 36/44 |
| 2016/0219970 | A1* | 8/2016 | Jacob | A43B 7/148 |

FOREIGN PATENT DOCUMENTS

| | | |
|---|---|---|
| KR | 20-19930024801 | 5/1992 |
| KR | 20-0312671 | 5/2003 |
| KR | 20-0427687 | 4/2006 |
| KR | 10-0641278 | 10/2006 |
| KR | 10-0736813 | 7/2007 |
| KR | 10-0780086 | 11/2007 |
| KR | 10-20090059886 | 6/2009 |
| KR | 10-0960562 | 6/2010 |
| KR | 10-1006923 | 1/2011 |
| KR | 10-1314656 | 10/2013 |
| KR | 10-1472734 | 12/2014 |
| WO | WO 2004060095 | 7/2004 |
| WO | WO 2006035469 | 4/2006 |
| WO | WO 2006090398 | 8/2006 |
| WO | WO 2007021328 | 2/2007 |
| WO | WO 2007056101 | 5/2007 |
| WO | WO 200815195 | 12/2008 |
| WO | WO 2009068298 | 6/2009 |
| WO | WO 2009126111 | 10/2009 |
| WO | WO 2009136685 | 11/2009 |
| WO | WO 2010124631 | 4/2010 |
| WO | WO 2011108011 | 9/2011 |
| WO | WO 2014036176 | 3/2014 |
| WO | WO 2014201423 | 12/2014 |
| WO | WO 2015038737 | 3/2015 |

OTHER PUBLICATIONS

[online] [retrieved on Jan. 22, 2013] [retrieved from geldoctor website] (pdf) http://www.geldoctor.com/flosole.html.

[online] [retrieved on Jan. 22, 2013] [retrieved from Gerbing's website] (pdf) http://www.gerbing.com/Products/insoles.php.

[online] [retrieved on Jan. 22, 2013] [retrieved from Heat Factory website] (pdf) http://www.heatfactory.com/english/product.pht?cat=3&id.

[online] [retrieved on Jan. 22, 2013] [retrieved from Dr. Rosenberg's Foot Products website] (pdf) http://www.instantarches.com/cool-soles.shtml.

[online] [retrieved on Jan. 22, 2013] [retrieved from Mean and Green website]web page] (pdf) http://www.meanandgreen.com/army/-Thermal-Foil_insoles/2660/2303.html.

[online] [retrieved on Jan. 22, 2013] [retrieved from Superfeet website] (pef) http://www.superfeet.com/products/REDHot.aspx.

[online] [retrieved on Jan. 22, 2013] [retrieved from Thermo Soles website] (pdf) http://www.thermosoles.com/.

[online] [retrieved on Jan. 22, 2014] [retreived from Warmers.com website] (pdf) http://www.warmers.com/grabber-got-warmers-medium-5-hour-10pr-bundle.

PCT, International Search Report & Written Opinion of the International Searching Authority for PCT/US2013/026932, dated Jun. 18, 2013.

PCT, International Search Report & Written Opinion of the International Searching Authority for Counterpart International Patent Application No. PCT/US2006/014681, dated Jul. 27, 2006.

PCT, International Search Report & Written Opinon of the International Searching Authority for Counterpart International Pataent Application No. PCT/US2013/057141, dated Nov. 12, 2013.

PCT, International Search Report & Written Opinon of the International Searching Authority for Counterpart International Patent Application No. PCT/US2014/0055133, dated Jan. 15, 2015.

PCT, International Search Report and Written Opinon of the International Searching Authority for Counterpart International Patent Application No. PCT/US2006/042885, dated Mar. 13, 2007.

Supplementary Extended European Search Report of the European Patent Office for European Search Report No. EP 13754536.4. dated Jun. 1, 2015.

PCT, International Search Report & Written Opinon of the International Searching Authority for Counterpart International Patent Application No. PCT/US2015/011960, dated Apr. 30, 2015.

PCT, International Search Report & Written Opinion of the International Searching Authority for International Patent Application No. PCT/US2016/028685, dated Jul. 29, 2016.

* cited by examiner

SHOE INSOLE

RELATED APPLICATION DATA

This application claims the benefit of U.S. Provisional Patent Application Ser. No. 62/167,791 filed May 28, 2015, U.S. Provisional Patent Application Ser. No. 62/182,103 filed Jun. 19, 2015, and U.S. Provisional Patent Application Ser. No. 62/213,037 filed Sep. 1, 2015.

TECHNICAL FIELD

The present invention relates in general to an improved shoe insole and more particularly to an insole providing improved cushioning and support to the foot of a wearer.

BACKGROUND OF THE INVENTION

The human foot is a very complex biological mechanism. The load on the foot at heel strike is typically about one and a half times a person's body weight when a person walks. When running or carrying extra weight, such as a backpack, loads on the foot can exceed three times the body weight. The many bones, muscles, ligaments, and tendons of the foot function to absorb and dissipate the forces of impact, carry the weight of the body and other loads, and provide forces for propulsion. Properly designed shoe insoles can assist the foot in performing these functions and protect the foot from injury.

Insoles may be custom made to address the specific needs of an individual. They may be made based on casts of the end user's foot or may be made of a thermoplastic material that is molded to the contours of the end user's foot. Like most custom made items, custom insoles tend to be expensive because of the low volume and extensive time needed to make and fit them properly. As such, it is not practical to make such custom made insoles for the general public.

To be practical for distribution to the general public, an insole must be able to provide benefit to the user without requiring individualized adjustment and fitting. A first type of insole commonly available over-the-counter emphasizes cushioning the foot so as to maximize shock absorption. For typical individuals cushioning insoles perform adequately while engaged in light to moderate activities, such as walking or running. That is, a cushioning insole provides sufficient cushioning and support for such activities. However, for more strenuous or technically challenging activities, such as carrying a heavy backpack or traversing difficult terrain, a typical cushioning insole will not be adequate. Under such conditions, a cushioning insole by itself would not provide enough support and control, and tends to bottom out during use by fully compressing the cushioning insole.

Another type of over-the-counter insole emphasizes control. Typically, such insoles are made to be relatively stiff and rigid so as to control the bending and twisting of the foot by limiting foot motion. The rigid structure is good at controlling motion, but is not very forgiving. As a result, when motion of the foot reaches a limit imposed by the rigid structure, the load on the foot tends to change abruptly and increases the load on the structures of the foot. Because biological tissues such as tendons and ligaments are sensitive to the rate at which they are loaded, the abrupt change in load causes injury or damage to the foot, ankle or leg.

In view of the foregoing, it would be desirable to provide an over-the-counter insole that provides both cushioning and control. It would also be desirable to provide an insole that provides both cushioning and control and is practical for use by the general public during cross-training or triathlon-related activities.

The Applicant has received patents for insoles having a stability cradle and multiple pods located thereon. These patents include U.S. Pat. Nos. 7,484,319; 7,665,169; 7,908,768; and, 8,250,784. These prior art patents, however, do not address the problems of enhanced cushioning and stability, possible movement of the insole during shoe operation, or establishing enhanced cushioning characteristics to address running and walking usages.

There is a present need for a shoe insole that accomplishes the goals to: (1) provide increased ankle and foot stability, (2) cushion the heel and forefoot during push-offs and landings, (3) custom-contour to the inside shape of all types of shoes, (4) be extremely light, (5) provide enhanced cushioning capabilities and (6) have essentially zero movement or sliding.

SUMMARY OF THE INVENTION

It is also an object of the present invention to provide an insole that provides improved cushioning, support, and control and is practical for use by the general public. The above, and other objects and advantages of the present are provided by an insole that provides improved motion control, support and cushioning. The insole includes a system of interacting components that cooperate to achieve a desired combination of foot cushioning, support and motion control.

In accordance with principles of the present invention, a cushioning core or base is combined with a relatively stiff stability cradle and a number of elastomeric pads to form an insole that provides greater cushioning, stability, and control than was conventionally known in the state of the art. The pads, including an extended heel pad that extends from the lateral midfoot area to the heel area and a supplemental heel pad that overlays a portion of the extended heel pad in the heel area, can have a different firmness than the base or the stability cradle. The extended heel pad assists with prevention of supination, and the supplemental heel pad assists with the prevention of pronation.

The current invention is an insole that provides a balanced approach to improving longitudinal arch support, prevention of pronation and prevention of supination by incorporation of the combination of the following elements: (1) a base having an extended heel pad indentation area, a stability cradle indentation area, and a forefoot pad indentation area, (2) an upper cooling top cloth, (3) a square faceted stability cradle with a plurality of stability ribs, (4) an elongated extended heel pad extending from the lateral midfoot area into the heel area, (5) a supplemental heel pad overlaying a portion of the elongated heel pad in the heel area; (6) a forefoot pad positioned in the forefoot indentation area; and, (7) square or rectangular groove patterns on the bottom surface of the stability cradle, extended heel pad, the forefoot pad and the supplemental heel pad.

The firmness of the extended heel pad and the supplemental heel pad can be adjusted to address issues of over/under pronation, over/under supination, and other problems related to foot motion by altering the size, shape, and material properties of the pads. The stability cradle, extended heel pad, supplemental heel pad, and forefoot pad have square faceted grooved patterns on their bottom surface for better cushioning and traction grip in the shoe. The present invention accomplishes the goals to: (1) improve ankle and foot stability, (2) cushion the heel and forefoot during push-offs and landings, (3) help prevent over pronation and over supination conditions, and (4) provide enhanced cushioning features to the heel, midfoot, arch and forefoot areas.

The characteristics of the components, their size and shape, and their position are selected to provide a desired blend of improved cushioning and control, and more specifically to achieve a desired biomechanical function. The size and compression characteristics of the pads can be adjusted to address issues of over/under pronation, over/under supination, and other problems related to foot motion, including altering the size, shape, and material properties of the pads.

In a preferred embodiment of the present invention, the components of an insole are permanently affixed to each other to create an insole designed for an intended type or category of activity. Many insole designs can be made to address a broad range of different activities.

BRIEF DESCRIPTION OF THE DRAWINGS

The above, and other objects and advantages of the present invention will be understood upon consideration of the following detailed description taken in conjunction with the accompanying drawings, in which like reference characters refer to like parts throughout, and in which.

DETAILED DESCRIPTION

Figure 1A:
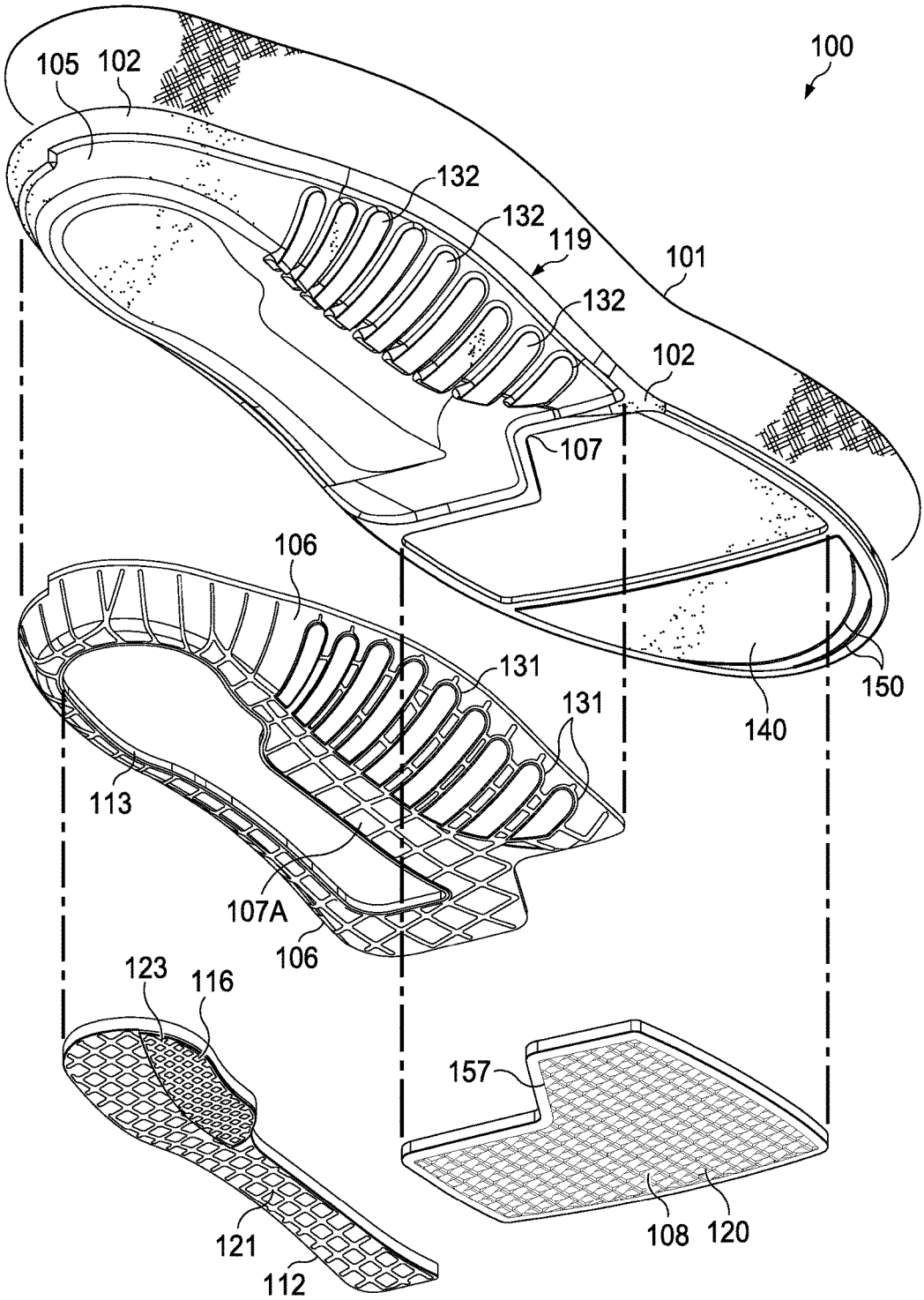
FIG. 1A is a exploded perspective view of an illustrative embodiment of an insole in accordance with the principles of the present invention.

In accordance with principles of the present invention, a cushioning core or base is combined with a relatively stiff stability cradle and a number of elastomeric pads to form an insole that provides greater cushioning, stability, and control than was conventionally known in the state of the art. The pads, including an extended heel pad that extends from the lateral midfoot area into the heel area and a supplemental heel pad that overlays a portion of the extended heel pad, can have a different firmness than the base and/or the stability cradle. The extended heel pad and the supplemented heel pad assists with prevention of supination or the prevention of pronation.

The combination of the base, stability cradle and heel pads provide a "degree" of medial longitudinal arch support, which provides a couple of degrees of improved pronation "control." A "degree" of medical longitudinal and support is just 1-2 of degrees based on research evidence. By pronation "control," we mean the increase in supination moments acting around the joints of the rearfoot and the decrease in the magnitude of pronation moments.

The current invention is an insole 100 that provides a balanced approach to improving longitudinal arch support, prevention of pronation and prevention of supination by incorporation of the combination of the following elements, such as: (1) a base having an extended heel pad indentation area, a stability cradle indentation area, and a forefoot pad indentation area, (2) an upper cooling top cloth, (3) a square faceted stability cradle with a plurality of stability ribs, (4) an elongated extended heel pad extending from the lateral midfoot area into the heel area, (5) a supplemental heel pad overlaying a portion of the elongated heel pad in the heel area; (6) a forefoot pad positioned in the forefoot indentation area, and, (7) square or rectangular groove patterns on the bottom surface of the stability cradle, extended heel pad, the forefoot pad and the supplemental heel pad.

The firmness of the extended heel pad and the supplemental heel pad can be adjusted to address issues of over/under pronation, over/under supination, and other problems related to foot motion, which means these pads can be altered by the size, shape, and material properties of the pads. The stability cradle, extended heel pad, supplemental heel pad, and forefoot pad have square faceted grooved patterns on their bottom surface for better cushioning and traction grip in the shoe. The present invention accomplishes the following goals to: (1) improved ankle and foot stability, (2) greater cushion of the heel and forefoot during push-offs and landings, (3) greater prevention of over pronation and over supination conditions, and (4) enhanced cushioning features to the heel, midfoot, arch and forefoot areas.

In reference to FIGS. 1A, 1B, and 2 through 7, an insole 100 constructed in accordance with the principles of the present invention is disclosed. It should be understood that insoles are generally adapted to be inserted inside the interior of a user's shoe and positioned on the bottom surface of the interior of the user's shoe. The insole 100 of the invention is shaped essentially like the bottom interior of an athletic shoe and therefore adapted to receive a user's foot which has a generally similar shape when at rest. The insole 100 extends from a heel end (proximal) to a toe end (distal) and has a medial border or side on the arch side of the foot, connecting said toe end to said heel end along the arch side of the insole and a lateral border or side on the other side (opposite side from medial side) thereof, connecting said toe end to said heel end on the other side of the insole.

The insole 100 also has a forefoot area that correlates with the metatarsal area and near the phalanges of the foot located over the toe pad 140 of the insole 102, an arch area along the medial side, a heel area just forward of the heel end, and a midfoot area between the heel area and forefoot area. A user's right shoe and left shoe are mirror images of one another as are the insoles adapted to be inserted in a right shoe and a left shoe respectively. Only the left insole is illustrated in the Figures. It will be understood by those of skill in the art that the right insole has a mirror image construction of the left insole.

Figure 1B:
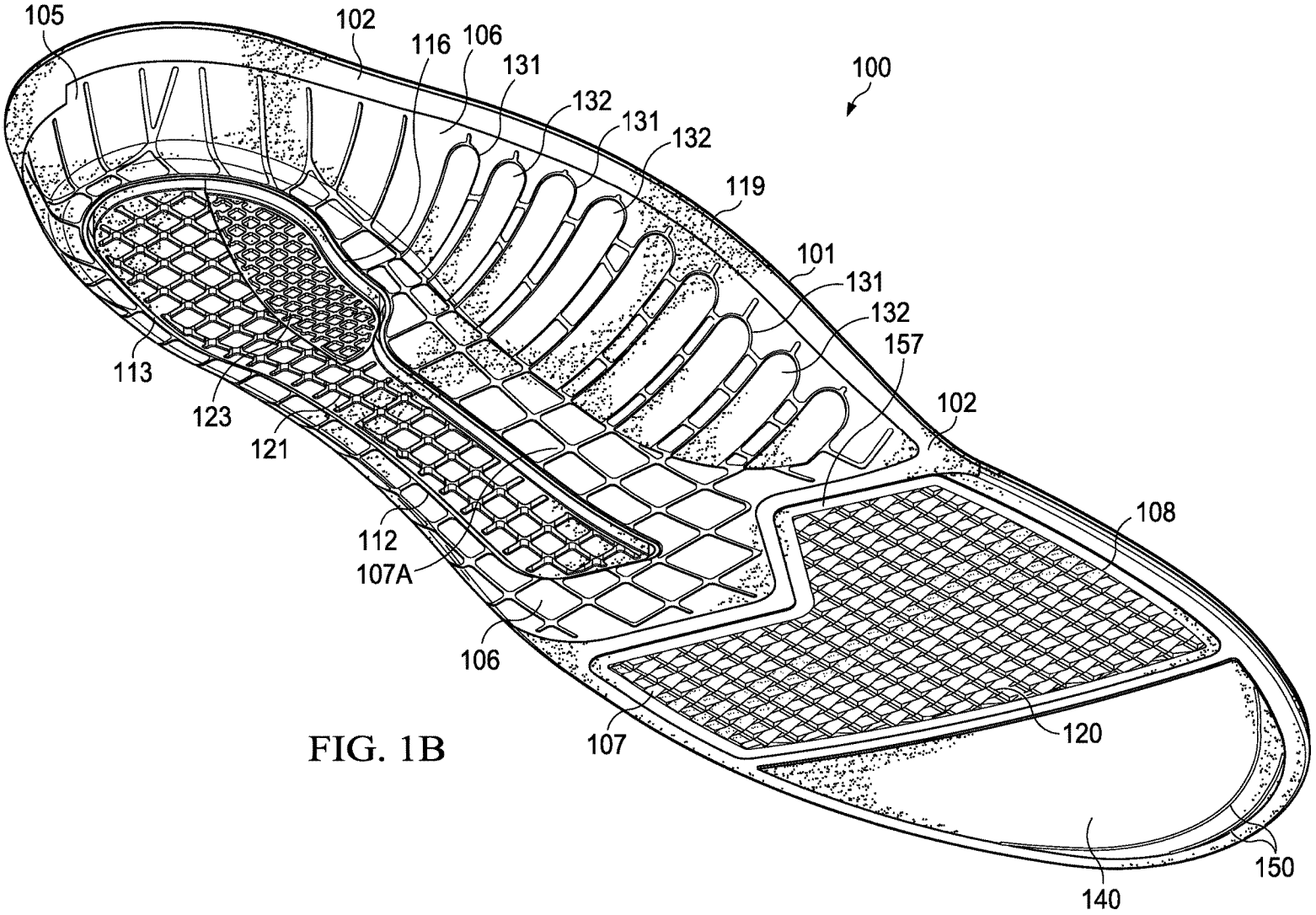
FIG. 1B is a bottom perspective view of an illustrative embodiment of an insole in accordance with the principles of the present invention.
Figure 2:
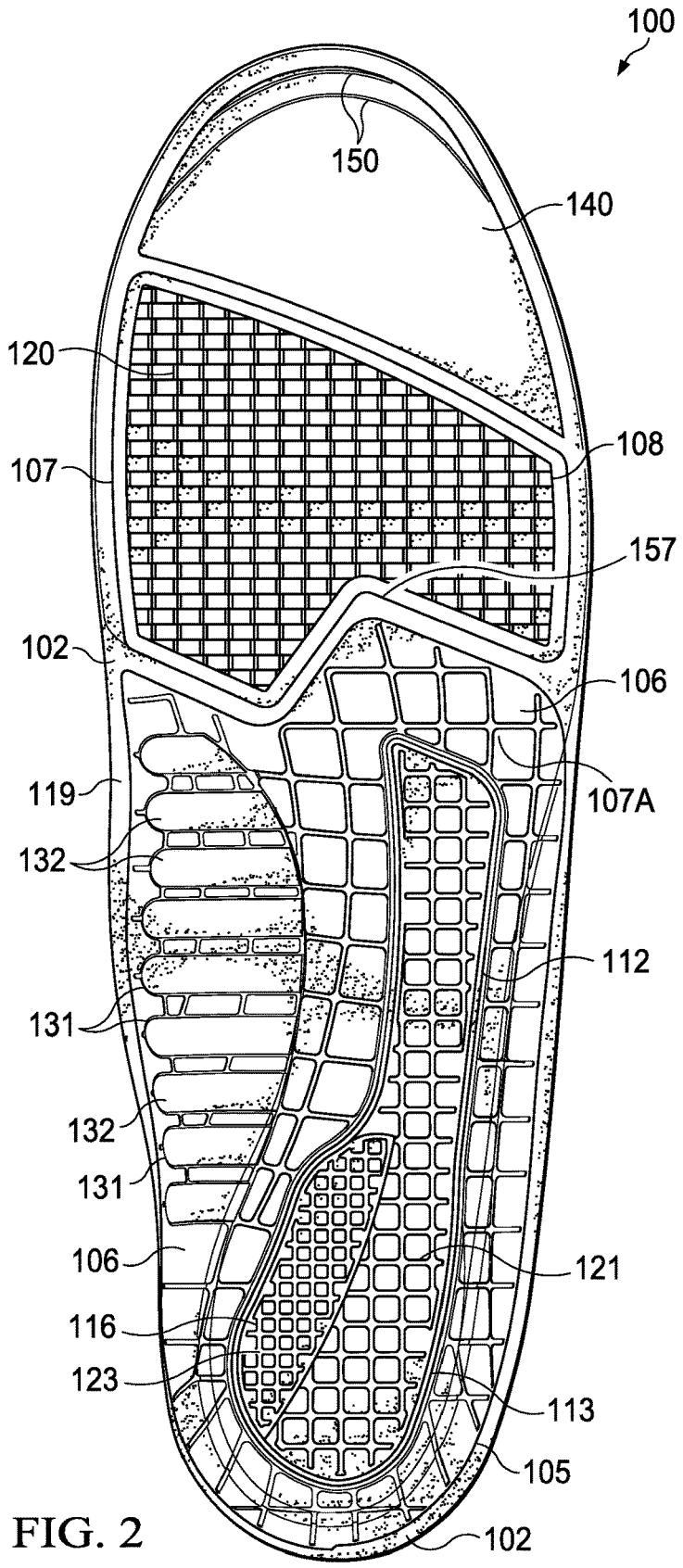
FIG. 2 is a bottom planar view showing the base of the insole.

As shown in FIGS. 1A, 1B and 2, insole 100 preferably comprises a top sheet 101 and a base 102 having a top surface secured to said top sheet and an opposite bottom surface. Base 102 also defines a longitudinal arch support 119 that extends upwardly along the medial side of the insole to provide extra cushion and support to the arch area of the foot.

Figure 4:
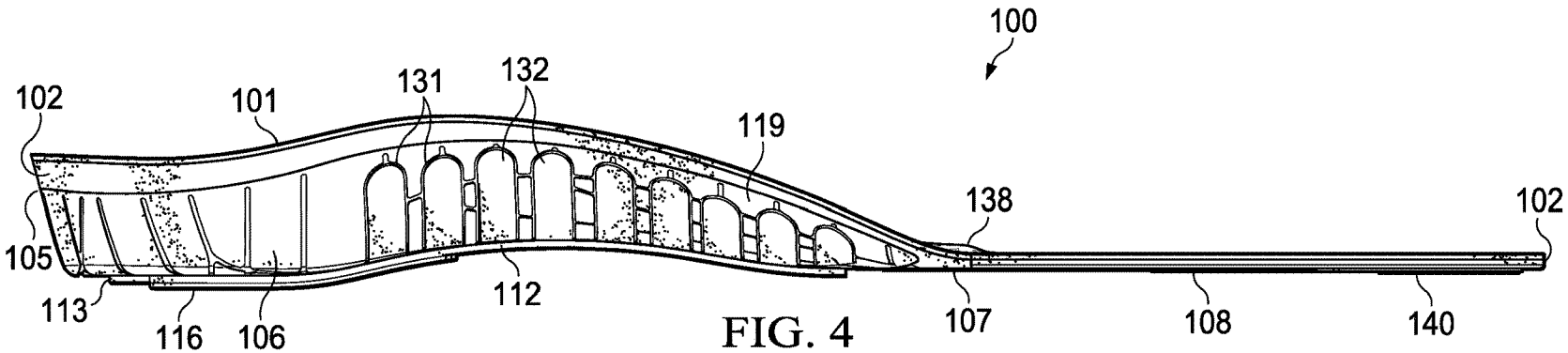
FIG. 4 is a medial (inner side) view of the insole.
Figure 7:
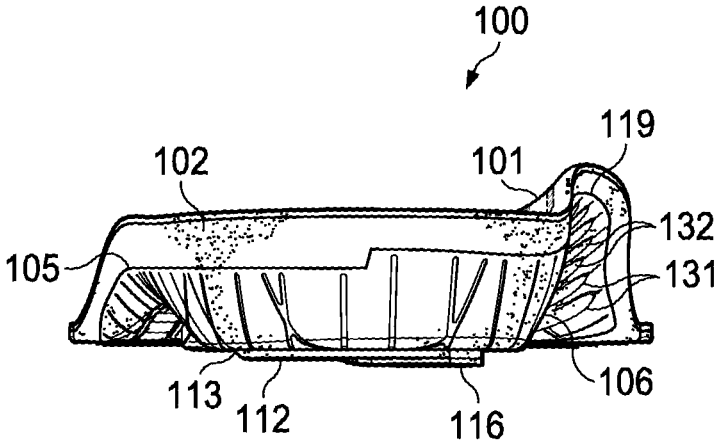
FIG. 7 is a rear (proximal) view of the insole.
Figure 11:
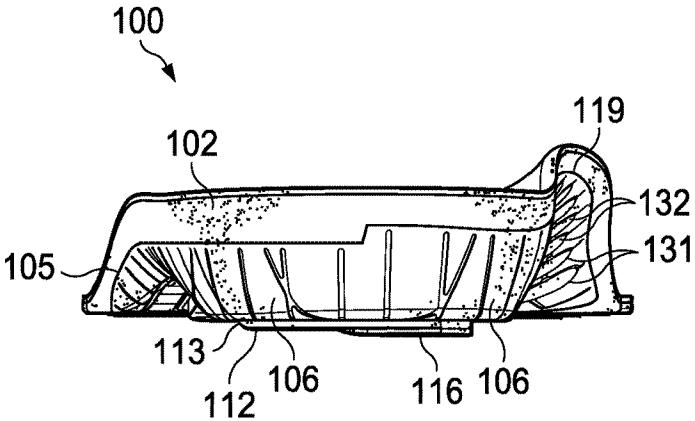
FIG. 11 is a rear (proximal) view of the insole.

Preferably, the top surface of the base defines an upwardly-extending portion or transverse arch support that lies under the metatarsal head area of the foot (best shown in FIGS. 4, 7 and 11). The upward extension of transverse arch support pushes up a portion of the top sheet 101 that corresponds to the area of the transverse arch support.

The bottom surface of base 102 defines a forefoot pad indentation area 107 in the forefoot area that correlates to the metatarsal area and near the phalanges of the foot located over the toe pad 140 of the insole 102, and a stability cradle indentation area 105 along the midfoot and heel areas. The bottom surface of base 102 also defines one or more ribs or protrusions 132 that extend outwardly along the arch area. The ribs 132 are preferably longer around the cuneiforms and gradually shorter distally and proximally from the cuneiforms creating a parabolic-like overall shape. An alternate embodiment has the ribs or protrusions defined by the stability cradle 106 and extending outwardly from the stability cradle 106 in the arch area.

Base 102 has a raised edge that wraps around the heel and extends partially along the sides of the foot such that the insole has a heel cup, which conforms to the natural shape of the foot. As best seen in FIGS. 4-5, 7, 9 and 11, the height of the raised edge is generally higher and thinner on the medial side of the insole and is lower and thicker on the lateral side of the insole.

The forefoot pad indentation area 107 begins partially proximal from the toe pad 140 of the insole 100 near the distal ends of the proximal phalanges of the foot. The forefoot pad indentation area 107 extends rearward to about the $3^{rd}$ through $5^{th}$ metatarsal heads on a lateral portion and approximately halfway along the $1^{st}$ and $2^{nd}$ metatarsals on a medial portion. Preferably the forefoot pad indentation area 107 has a rear apex 157 that lies between the $1^{st}$ and $2^{nd}$ metatarsals.

Forefoot pad 108 is shaped essentially the same as forefoot pad indentation area 107 and is secured therein. Forefoot pad 108 has a medial edge, a lateral edge, a proximal (back) edge and a distal (front) edge. The medial edge of forefoot pad 108 extends along a line spaced laterally from said medial border of said insole. The proximal edge extends from said medial edge laterally and proximally to said rear apex 157, laterally and distally towards the $3^{rd}$ metatarsal head, then laterally and proximally to the lateral edge approximately along the $3^{rd}$ through $5^{th}$ metatarsal heads. The lateral edge of the forefoot pad connects said proximal edge to said top edge of said forefoot pad. In use, forefoot pad indentation area 107 and forefoot pad 108 underlie a portion of the big toe of a user's foot, and the "ball" of the foot, excluding the first metatarsal head or medial ball of the user's foot.

An adhesive is be used to secure the components. The forefoot pad 108 provides cushioning and energy return on landing from a vertical jump. It serves as a propulsion pad and support for the metatarsal heads of a user's foot, especially the $1^{st}$ and $2^{nd}$ metatarsal heads. It is estimated that using tougher materials increases the durability of the insole by 35% to 65% over insoles that use softer materials for this portion of the foot insole. The forefoot pad 108 has a square faceted grid formation that improves durability and cushioning aspects of the forefoot pad over known materials.

The stability cradle indentation area 105 is located in the midfoot and heel areas of the bottom surface of base 102. The stability cradle indentation area 105 extends from a medial edge approximate the medial border to a lateral edge approximate the lateral border of the base and from a distal edge slightly proximal of the forefoot pad indentation area 107 to a proximal edge approximate the heel end of the base. A medial portion of the distal edge is shaped to accommodate downward motion of the $1^{st}$ metatarsal during toe off. Stability cradle 106 is shaped essentially the same as stability cradle indentation area 105 and has a base facing surface and a shoe facing surface. The base facing surface is secured to said stability cradle indentation area 105.

Stability cradle 106 has side and end walls that wrap up the sides and rear of base 102 to provide support for the foot by cupping the outside areas of the heel, providing stability stiffness from the mid-foot to the heel area, and providing an upward support in the medial arch area of the user's foot. Preferably, stability cradle 106 ranges from approximately 0.5 mm to 3 mm thick and the walls taper from approximately 3 mm to about 0.5 mm. The sides of stability cradle 106 are preferably higher on the medial side of the foot because of the higher loading. Preferably, stability cradle 106 is made of a nylon material with a hardness of approximately Shore A85-A110. In a preferred embodiment, the stability cradle is semi-rigid. In an alternate embodiment, the stability cradle is rigid.

Preferably, the surface of stability cradle 106 that faces the internal portion of the shoe has a square "faceted" surface texture. This textured faceted surface increases the ability of the insole to "stay in place" when a user's foot is being placed into or out of the shoe. These faceted textures significantly improve the use and performance of these insoles for this particular use by allowing the insole to resist movement out of the shoe. The square "faceted" design increases the internal function quotient of the insole significantly (by as much as 50% compared to non-faceted or smooth stability cradles) when located in the shoe cavity, thereby preventing the insole's movement or exit from the shoe cavity. The stability cradle 106, extended heel pad 112, supplemental heel pad 116, and forefoot pad 108 have square "faceted" grooved patterns shown at 107A, 120, 121, and 123, respectively, on their bottom surfaces for better cushioning and traction grip inside the internal surface of the shoe.

The stability cradle 106 preferably defines one or more rib-shaped openings 131 in the medial arch area. In a preferred embodiment, the rib-shaped openings 131 allow said ribs 132 of base 102 to extend therethrough. Preferably, base 102 is molded so that the ribs 132 project into rib-shaped openings 131 so that the ribs 132 are approximately flush with the outer surface of stability cradle 106 and mechanically lock stability cradle 106 and base 102 together. Advantageously, the ribs 132 are also able to bulge through rib-shaped openings 131 when base 102 is compressed (e.g., while walking or running) to provide additional cushioning and support to the arch of the foot. Preferably said ribs 132 extend outwardly approximately 0.50 mm to 1.5 mm and have a width of approximately 4 mm. The rib-shaped openings 131 allow the stability cradle 106 to be more flexible in the arch area compared to the rest of the stability cradle 106. One or more sheets of reinforcing materials may be placed in the stability cradle 106 or between the stability cradle 106 and the base 102 to increase the durability and strength/firmness of the insole. Reinforcing sheet materials can include any type of composite weaved material or any type of woven or non-woven sheet material that does not "shrink" in size or warp in shape over time.

In an alternate embodiment, stability cradle 106 defines one or more protruding ribs instead of openings. The protruding ribs extend outwardly along the arch area. The protruding ribs are longer around the cuneiforms and gradually shorter distally and proximally from the cuneiforms creating a parabolic-like overall shape. The protruding ribs extend outward approximately 0.50 mm.

Stability cradle 106 defines an extended heel pad opening 113 that extends from behind the $3^{rd}$ through $5^{th}$ metatarsal heads proximally to the back of the cuboid and further back along the lateral side of the heel area of stability cradle 106 into the heel area. The length of the extended heel pad opening 113 is preferably sufficient to provide cushioning to the lateral aspect from the midfoot into the heel area. Extended heel pad 112 is shaped essentially the same as the extended heel pad opening 113 and is secured to the bottom surface of base 102 within the stability cradle indentation area 105 in a location that correlates to the extended heel pad opening 113 and allows the extended heel pad 112 to extend out through said extended heel pad opening 113.

Extended heel pad 112 is preferably made from a thermoplastic rubber ("TPR") or a polyurethane ("PU") of a hardness of about 45-50 ASKER C. If TPR is used, a fabric is in turn secured to the base 102 in the extended heel pad opening 113 of said base 102. The fabric component allows the TPR to properly adhere to the base 102.

The supplemental heel pad 116 overlays a portion of the extended heel pad 112 in the heel area. The supplemental heel pad 116 is shaped to overlay a portion of the extended heel pad 112 and is secured to the bottom surface of the extended heel pad 112 by an adhesive or mechanical fastener (e.g. hook and loop fasteners) in a location that correlates to a portion of the heel area and a portion of the extended heel pad 112 that extends through the extended heel pad opening 113. The supplemental heel pad 116 has a side edge which extends along the medial side of the extended heel pad 112 located in the heel area. The side edge extends around a portion of the heel area up to a mid-section of the heel area. The supplemental heel pad 116 can, alternatively, be located on the lateral side of the extended heel pad 112 instead of on the medial side of the heel area. The supplemental heel pad 116 is preferably made from TPR or PU of a hardness of about 60 ASKER C±3. If TPR is used, a fabric is in turn secured to the base 102 to permit the TPR to properly adhere to the base 102.

The firmness of the extended heel pad 112 and the supplemental heel pad 116 can be adjusted to address issues of over/under pronation, over/under supination, and other problems related to foot motion by altering the size, shape, and material properties of the pads. The configuration, material and position of the supplemental heel pad 116 provides cushioning and works in association with the extended heel pad 112 to stabilize the ankle. The hardness of the supplemental heel pad 116 and the extended heel pad 112 can be essentially the same, which works in concert with each other to help reduce the incidence of lateral ankle roll-overs. These heel pads are preferably made of TPR or PU of a hardness of about Shore C 45-50. If TPR is used, a fabric is in turn secured to the base 102 in the extended heel pad opening 113 of said base 102. The fabric component allows the TPR to properly adhere to the base 102.

A top sheet 101 is oriented to engage the user's foot on the top surface of the insole, and it serves an upper cooling and ventilation function. The top sheet 101 can be made of suitable materials, such as a jadeite top cloth material.

Foot contact with the ground is generally divided into three phases: heel strike, midfoot support, and toe off. During heel strike, the heel of the foot impacts the ground with significant force. Following the initial impact of the heel with the ground, the foot twists, or pronates, bringing the medial side of the heel into contact with the ground. The foot is sensitive to the amount of pronation as well as the rate at which the pronation occurs. Pronation is natural, and some degree of pronation is desirable because it serves to absorb the stresses and forces on the foot during walking or running. However, an excessive amount or rate of pronation can result in injury.

To cushion the impact, the extended heel pad 112 and the supplemental heel pad 116 work in conjunction with the stability cradle 106 to accomplish the goals of the invention, such as: (1) improving ankle and foot stability, (2) cushioning the heel and forefoot during push-offs and landings, (3) helping prevent over pronation and over supination conditions, and (4) providing enhanced cushioning features to the heel, midfoot, arch and forefoot areas. Stability cradle 106 provides firm support along the medial portion of the foot, including the medial arch area and surrounding the heel area, to help control the amount of foot pronation. The extended heel pad 112 and the supplemental heel pad 116 also helps to control the rate of pronation.

By forming the supplemental heel pad 116 out of a material having different characteristics than extended heel pad 112, the pronation and supination rates can be regulated, controlled and increased/decreased. For example, to reduce a pronation rate, supplemental heel pad 116 can be made from a firmer material than extended heel pad 112. A firmer or stiffer material does not compress as much or as fast as a softer material under the same load. Thus, a supplemental heel pad 116 made from a firmer material would compress less than an extended heel pad 112 made of a softer material. As a result, the supplemental heel pad 116, when overlayed on the medial side of the heel area on the extended heel pad 112 and when constructed of this type of firmer material, would tend to resist or counteract pronation and thereby help to reduce the degree and rate of pronation. Conversely, locating the supplemental heel pad 116 on the lateral side of the heel area on the extended heel pad 112 would tend to decrease the rate of supination and increase the amount and rate of pronation.

Preferably, the position of the supplemental heel pad 116 and firmness of the material used in supplemental heel pad 116 is selected based on the firmness of extended heel pad 112, on the type of intended activity, and the pronation/supination rates that are desired to be increased or decreased. For example, the firmness of extended heel pad 112 and the supplemental heel pad 116 differs by about 20-30% for an insole to be used during light to moderate activities. Carrying a heavy backpack or other articles significantly increases the load on the foot and the rate of pronation during and following heel strike. Accordingly, when the supplemental heel pad 116 is made of significantly firmer material than the extended heel pad 112 in an insole designed for use while backpacking, a difference in firmness of about 20-40% is more appropriate for such activities.

Extended heel pad 112 provides cushioning and control to the lateral side of the foot during the midstance portion of a step. The extended heel pad 112 can be formed of a material having the same properties, e.g., firmness, as supplemental heel pad 116. However, a material having different characteristics may also be used.

The extended heel pad 112 and the supplemental heel pad 116 is employed to cause a kinetic change in foot function to promote ankle stability. It is also contemplated that making the extended heel pad 112 softer than the firmness of the supplemental heel pad 116 will address and minimize certain joint moments or ankle rolls.

At the beginning of the propulsion or toe off phase of a step, the heel begins to lift from the ground and weight shifts to the ball of the foot. Forefoot pad 108 is located under this part of the foot. Preferably, forefoot pad 108 is formed of a relatively resilient material so that energy put into compressing forefoot pad 108 is returned to help propel the foot at toe off.

During toe off, the first metatarsal naturally flexes downward. Preventing this natural downward flex of the first metatarsal causes the arch of the foot to flatten and the foot to over pronate, increasing stress on the ankles and knees. To accommodate the downward flex, the medial portion 157 of forefoot pad 108 extends rearward into a corresponding concave edge portion of the distal edge of stability cradle 106. The shape of the stability cradle 106 and forefoot pad 108 permit the first metatarsal to flex more naturally and thereby encourage loading of the great toe during toe off.

Forefoot pad 108 is preferably made from a Thermoplastic Rubber ("TPR") or Polyurethane ("PU"). The hardness of the TPR or PU used in the forefoot pad 108 is preferably about 30 Asker C±3. For a men's size 11-12 insole, the width of the forefoot pad from the medial to lateral side is about 85 to 95 mm. The height is about 100 to 110 mm. The depth is about 0.95 to 1.50 mm.

The square "faceted" groove pattern 120 on the forefoot pad 108, the square "faceted" groove pattern 121 on the extended heel pad 112, the square "faceted" groove pattern 123 on the supplemental heel pad 116, and the square "faceted" groove pattern 107A on the stability cradle 106, are constructed on the bottom surface of the insole to make contact with the bottom internal shoe surface. The square "faceted" groove pattern introduces air gaps into the pad surfaces, which positively influences the impact absorption properties of each pad as well as allowing for use of less material and providing for a lighter insole while still providing the desired cushioning function. Preferably, the square "faceted" groove pattern 120 on the forefoot pad 108 and groove pattern 123 on supplemental heel pad 116 is approximately 0.10 to 0.35 mm deep. Preferably, the square "faceted" groove pattern 107A on the stability cradle 106 and the groove pattern 121 on the extended heel pad 112 are approximately 0.025 to 0.75 mm deep. The square "faceted" groove patterns assist with securing the insole inside the shoe cavity and keeping the insole in place on the bottom interior surface of the shoe such that the insole will not move or slide around, as well as allowing air circulation and/or providing different cushioning and spring properties.

Base 102 is preferably made of foam or other material having suitable cushioning properties. Preferably, base 102 comprises an Ethylene vinyl acetate ("EVA") foam, which is a copolymer of ethylene and vinyl acetate, a Thermoplastic Rubber ("TPR")/EVA mix, or a blown EVA material. A preferred blown EVA, EVA or TPR/EVA mix has a durometer (hardness) of about Asker C 45-50.

It is desirable to minimize the total weight of the insoles by selection of materials that promote the structural features of the insole. It is desirable that the total weight of the preferred embodiment of the insole (men's size 10/11) be about 4.0 ounces. It is desirable that the total weight of an alternate embodiment of the insole be about 5.0 to 6.0 ounces for a men's size 10/11 and about 6.5 to 7.5 ounces for a men's size 12/13. Other sizes will be proportional. Using the square "faceted" groove pattern designs will also help provide for a lighter insole.

In a preferred embodiment, base 102 is covered with top sheet 101 from toe to heel areas of the insole, which is preferably a non-woven fabric layer with a low coefficient of friction so as to minimize the possibility of blisters. Preferably, top sheet 101 is made of a cooling fabric which contains a special low temperature jade obtained from a natural source. The form of jade in the fabric is a jadeite. In a preferred embodiment, the fabric is treated with an antibacterial agent, which in combination with a moisture barrier reduces odor causing bacteria and fungi.

In a first preferred embodiment of the present invention, the various pad components of an insole which are secured to base 102 in the indentation areas defined by base 102 on the bottom surface and are permanently affixed to base 102 using an appropriate means such as an adhesive or a mechanical fastener (e.g. hook and loop). The components can also be secured during the molding process using techniques known in the art of molding insoles.

The indentation areas can also be lined with a cloth having a base surface and a pad surface, or secured to said base 102 along said base surface and said pad along said pad surface. Alternatively, a cloth is secured to pad and then the composite structure secured to the indentation area.

Some shoes may slightly differ in size on the inner part of the shoe. Some shoes may also provide extra padding along the inner sides, front or back of the shoe that alter the actual space provided for the foot and/or an insole on the inner part of the shoe. Base 102 may have sizing guides 150 that allow a user to shorten the length of the insole for proper fit within the shoe. Sizing guides 150 provide various cutting guide lines that the user would cut along, preferably with scissors.

Figure 3:
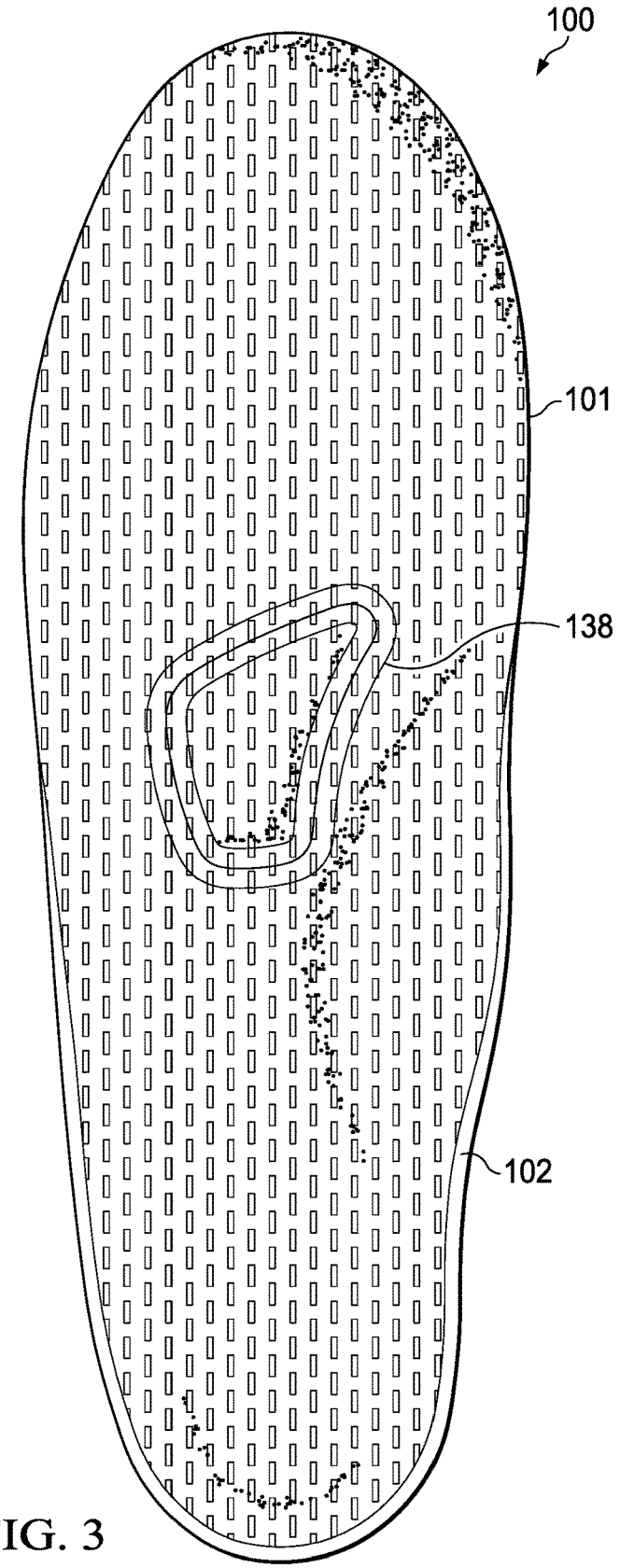
FIG. 3 is a top (dorsal) view of the insole.

FIG. 3 is a top view of the insole 100 illustrating the top sheet 101 and transverse arch support 138. Insole 100 comprises a top sheet 101 secured across the entire top surface of the base 102 from toe area to heel area. Preferably, the top surface of the base 102 defines an upwardly-extending portion or transverse arch support 138 that lies under the metatarsal head area of the foot. The upward extension of transverse arch support 138 pushes up a portion of the top sheet 101 that corresponds to the area of the transverse arch support 138.

Transverse arch support 138 preferably lies under the second to fourth metatarsal heads. Transverse arch support 138 provides additional stability and cushioning to the forefoot and middle of the foot.

In a preferred embodiment, top sheet 101 is a non-woven fabric layer with a low coefficient of friction so as to minimize the possibility of blisters. Preferably, top sheet 101 is made of a cooling fabric which contains a special low temperature jade obtained from a natural source. The form of jade in the fabric is a jadeite. In a preferred embodiment, the fabric is treated with an antibacterial agent, which in combination with a moisture barrier reduces odor causing bacteria and fungi. A series of air holes extend through top sheet 101 and the base 102 to permit air circulation above and below insole 100.

FIG. 4 illustrates a medial side view of the insole. Insole 100 preferably comprises a top sheet 101 and a base 102 having a top surface secured to said top sheet and an opposite bottom surface. Base 102 also defines a longitudinal arch support 119 that extends upwardly along the medial side of the insole to provide extra cushion and support to the arch area of the foot.

The bottom surface of base 102 defines a forefoot pad indentation area 107 in the forefoot area and a stability cradle indentation area 105 along the midfoot and heel areas. The bottom surface of base 102 also defines one or more ribs or protrusions 132 that extend outwardly along the arch area. The ribs 132 are preferably longer around the cuneiforms and gradually shorter distally and proximally from the cuneiforms creating a parabolic-like overall shape. In a preferred embodiment, the rib-shaped openings 131 allow said ribs 132 of base 102 to extend therethrough.

Preferably, base 102 is molded so that the ribs 132 project into rib-shaped openings 131 so that the ribs 132 are approximately flush with the outer surface of stability cradle 106 and mechanically lock stability cradle 106 and base 102 together. Advantageously, the ribs 132 are also able to bulge through rib-shaped openings 131 when base 102 is compressed (e.g., while walking or running) to provide additional cushioning and support to the arch of the foot. Preferably said ribs 132 extend outwardly approximately 0.50 mm to 1.5 mm and have a width of approximately 4 mm. The rib-shaped openings 131 allow the stability cradle 106 to be more flexible in the arch area compared to the rest of the stability cradle 106.

In an alternate embodiment, stability cradle 106 defines one or more protruding ribs instead of openings. The protruding ribs extend outwardly along the arch area. The protruding ribs are longer around the cuneiforms and gradually shorter distally and proximally from the cuneiforms creating a parabolic-like overall shape. The protruding ribs extend outward approximately 0.50 mm.

Base 102 has a raised edge along the medial arch area and wraps around the outside edge of the heel area and extends partially along the sides of the foot such that the insole has a heel cup, which conforms to the natural shape of the foot. The height of the raised edge is generally higher and thicker on the medial side of the insole and is lower and thinner on the lateral side of the insole.

The forefoot pad indentation area 107 begins partially proximal from the toe pad 140 of the insole 100 near the distal ends of the proximal phalanges of the foot. The forefoot pad indentation area 107 extends rearward to about the 3rd through 5th metatarsal heads on a lateral portion and approximately halfway along the 1st and 2nd metatarsals on a medial portion. Preferably the forefoot pad indentation area 107 has a rear apex that lies between the 1st and 2nd metatarsals. A forefoot pad 108 is shaped essentially the same as forefoot pad indentation area 107 and is secured therein.

The stability cradle indentation area 105 is located in the midfoot and heel areas of the bottom surface of base 102. The stability cradle indentation area 105 extends from a medial edge approximate the medial border to a lateral edge approximate the lateral border of the base 102 and from a distal edge slightly proximal of the forefoot pad indentation area 107 to a proximal edge approximate the heel end of the base. A medial portion of the distal edge is shaped to accommodate downward motion of the 1st metatarsal during toe off. Stability cradle 106 is shaped essentially the same as stability cradle indentation area 105 and has a base facing surface and a shoe facing surface. The base facing surface is secured to said stability cradle indentation area 105.

Stability cradle 106 has walls that wrap up the sides and rear of base 102 to provide support for the foot. Preferably, stability cradle 106 ranges from approximately 0.5 mm to 3 mm thick and the walls taper from approximately 3 mm to about 0.5 mm. The sides of stability cradle 106 are preferably higher on the medial side of the foot because of the higher loading.

Stability cradle 106 defines an extended heel pad opening 113 that extends from the lateral midfoot area to the heel area along the lateral side of the midfoot area. Specifically, stability cradle 106 defines an extended heel pad opening 113 that extends from behind the $3^{rd}$ through $5^{th}$ metatarsal heads proximally to the back of the cuboid. Stability cradle 106 defines an extended heel pad opening 113 that extends through the lateral side of the heel area of stability cradle 106 from approximately rearward of the extended heel pad opening toward the heel end. The extended heel pad 112 is shaped essentially the same as extended heel pad opening 113 and is secured to the bottom surface of base 102 within the stability cradle indentation area 105 in a location that correlates to the extended heel pad opening 113 and allows the extended heel pad 112 to extend out through said extended heel pad opening 113.

Supplemental heel pad 116 overlays onto a portion of the extended heel pad 112 in the heel pad area. This supplemental heel pad 116 provides directional support and cushioning over this overlaid area of the extended heel pad 112 and is constructed as described above with respect to FIGS. 1A, 1B and 2. The supplemental heel pad 116 is affixed to the extended heel pad 112 by an adhesive or mechanical fastener (e.g. hook and loop fastener).

In a preferred embodiment, base 102 is covered with top sheet 101, which is preferably a non-woven fabric layer with a low coefficient of friction so as to minimize the possibility of blisters. Preferably, top sheet 101 is made of a cooling fabric which contains a special low temperature jade obtained from a natural source. The form of jade in the fabric is a jadeite. In a preferred embodiment, the fabric is treated with an antibacterial agent, which in combination with a moisture barrier reduces odor causing bacteria and fungi.

Preferably, the top surface of the base 102 defines an upwardly-extending portion or transverse arch support 138 that lies under the metatarsal head area of the foot. The upward extension of transverse arch support 138 pushes up a portion of the top sheet 101 that corresponds to the area of the transverse arch support 138. Transverse arch support 138 preferably lies under the second to fourth metatarsal heads. Transverse arch support 138 provides additional stability and cushioning to the forefoot and middle of the foot.

Figure 5:
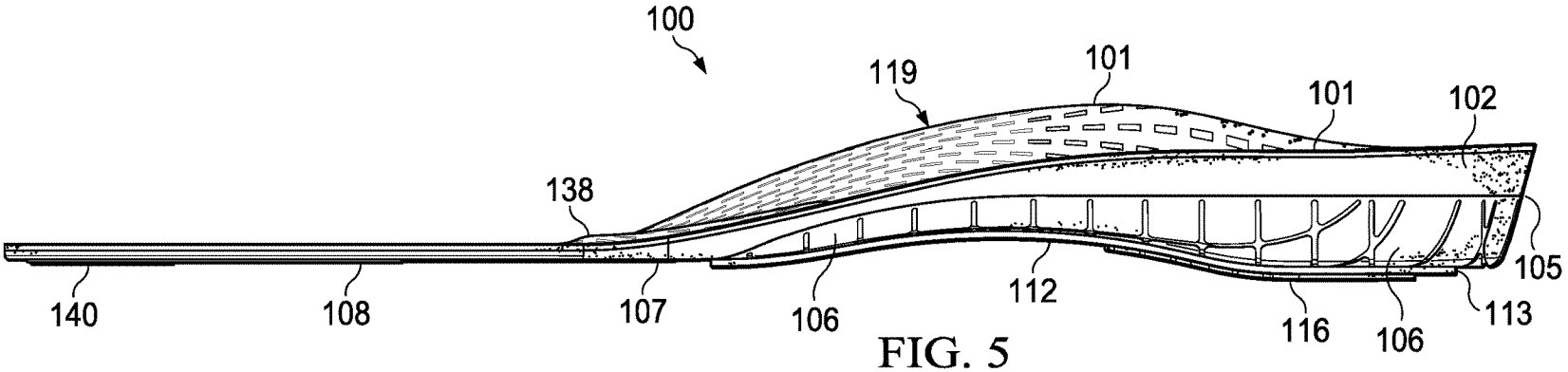
FIG. 5 is a lateral (outer side) view of the insole.

FIG. 5 illustrates a lateral side view of the insole. Insole 100 preferably comprises a top sheet 101 and a base 102 having a top surface secured to said top sheet 101 and an opposite bottom surface. Base 102 also defines a longitudinal arch support 119 that extends upwardly along the medial side of the insole to provide extra cushion and support to the arch area of the foot. The bottom surface of base 102 defines a forefoot pad indentation area 107 in the forefoot area and a stability cradle indentation area 105 along the midfoot and heel areas.

Base 102 has a raised edge that wraps around the heel and extends partially along the sides of the foot such that the insole has a heel cup, which conforms to the natural shape of the foot. The height of the raised edge is generally and thicker on the medial side of the insole and is lower and thinner on the lateral side of the insole.

The forefoot pad indentation area 107 begins partially proximal from the toe pad 140 of the insole 100 near the distal ends of the proximal phalanges of the foot. The forefoot pad indentation area 107 extends rearward to about the 3rd through 5th metatarsal heads on a lateral portion and approximately halfway along the 1st and 2nd metatarsals on a medial portion. Preferably the forefoot pad indentation area 107 has a rear apex that lies between the 1st and 2nd metatarsals. A forefoot pad 108 is shaped essentially the same as forefoot pad indentation area 107 and is secured therein.

The stability cradle indentation area 105 is located in the medial midfoot area and extends around the heel area of the bottom surface of base 102. The stability cradle indentation area 105 extends from a medial edge approximate the medial border to a lateral edge approximate the lateral border of the base and from a distal edge slightly proximal of the forefoot pad indentation area 107 to a proximal edge approximate the heel end of the base. A medial portion of the distal edge is shaped to accommodate downward motion of the 1st metatarsal during toe off. Stability cradle 106 is shaped essentially the same as stability cradle indentation area 105 and has a base facing surface and a shoe facing surface. The base facing surface is secured to said stability cradle indentation area 105.

Stability cradle 106 defines an extended heel pod opening 113 that extends from behind the $3^{rd}$ through $5^{th}$ metatarsal heads proximally to the back of the cuboid. Stability cradle 106 has walls that wrap up the sides and surround the rear of base 102 to provide support for the foot. Preferably, stability cradle 106 ranges from approximately 0.5 mm to 3 mm thick and the walls taper from approximately 3 mm to about 0.5 mm. The sides of stability cradle 106 are preferably higher on the medial side of the foot because of the higher loading.

An extended heel pad 112 is shaped essentially the same as the extended heel pad opening 113 and is secured to the bottom surface of base 102 within the stability cradle indentation area 105 in a location that correlates to the extended heel pad opening 113 and allows the extended heel pad 112 to extend out through said extended heel pad opening 113.

Supplemental heel pad 116 overlays onto a portion of the extended heel pad 112. This supplemental heel pad 116 provides directional support and cushioning over this overlaid area of the extended heel pad 112 and is constructed as described above with respect to FIGS. 1A, 1B and 2. The supplemental heel pad 116 is affixed to the extended heel pad 112 by an adhesive or mechanical fastener.

In a preferred embodiment, base 102 is covered with top sheet 101, which is preferably a non-woven fabric layer with a low coefficient of friction so as to minimize the possibility of blisters. Preferably, top sheet 101 is made of a cooling fabric which contains a special low temperature jade obtained from a natural source. The form of jade in the fabric is a jadeite. In a preferred embodiment, the fabric is treated with an antibacterial agent, which in combination with a moisture barrier reduces odor causing bacteria and fungi.

Preferably, the top surface of the base 102 defines an upwardly-extending portion or transverse arch support 138 that lies under the metatarsal head area of the foot. The upward extension of transverse arch support 138 pushes up a portion of the top sheet 101 that corresponds to the area of the transverse arch support 138. Transverse arch support 138 preferably lies under the second to fourth metatarsal heads. Transverse arch support 138 provides additional stability and cushioning to the forefoot and middle of the foot.

Figure 6:
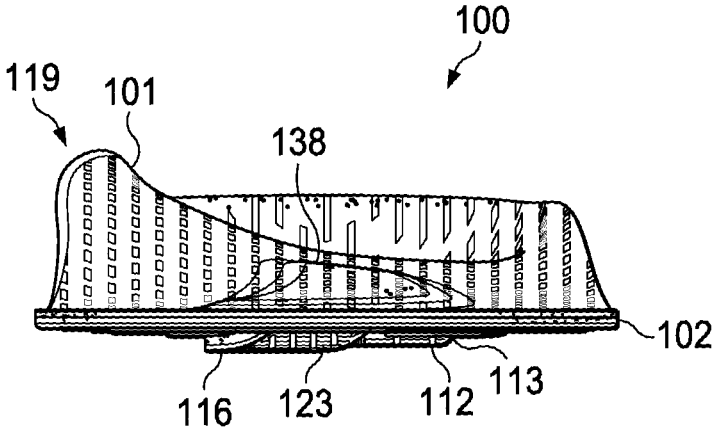
FIG. 6 is a front (proximal) view of the insole.

FIG. 6 illustrates the front view of the insole 100, and FIG. 7 illustrates a rear view of the insole 100. Insole 100 preferably comprises a top sheet 101 and a base 102 having a top surface secured to said top sheet 101 and an opposite bottom surface. Base 102 also defines a longitudinal arch support 119 that extends upwardly along the medial side of the midfoot area of the insole to provide extra cushion and support to the arch area of the foot.

The bottom surface of base 102 defines a stability cradle indentation area 105 along the midfoot and heel areas. The bottom surface of base 102 also define one or more ribs or protrusions 132 that extend outwardly along the arch area. The stability cradle 106 preferably defines one or more rib-shaped openings 131. In a preferred embodiment, the rib-shaped openings 131 allow said ribs 132 of base 102 to extend therethrough. Preferably, base 102 is molded so that the ribs 132 project into rib-shaped openings 131 so that the ribs 132 are approximately flush with the outer surface of stability cradle 106 and mechanically lock stability cradle 106 and base 102 together. Advantageously, the ribs 132 are also able to bulge through rib-shaped openings 131 when base 102 is compressed (e.g., while walking or running) to provide additional cushioning and support to the arch of the foot.

The rib-shaped openings 131 allow the stability cradle 106 to be more flexible in the arch area compared to the rest of the stability cradle 106. In an alternate embodiment, stability cradle 106 defines one or more protruding ribs instead of openings. The protruding ribs extend outwardly along the arch area. The protruding ribs are longer around the cuneiforms and gradually shorter distally and proximally from the cuneiforms creating a parabolic-like overall shape. The protruding ribs extend outward approximately 0.50 mm. The ribs 132 are preferably longer around the cuneiforms and gradually shorter distally and proximally from the cuneiforms creating a parabolic-like overall shape. An alternate embodiment has the ribs or protrusions defined by the stability cradle 106 and extending outwardly from the stability cradle 106 in the arch area.

Base 102 has a raised edge that wraps around the heel and extends partially along the sides of the foot such that the insole has a heel cup, which conforms to the natural shape of the foot. The height of the raised edge is generally lower and thinner on the lateral side of the insole and is higher and thicker on the medial side of the insole.

Supplemental heel pad 116 overlays onto a portion of the extended heel pad 112 and has a square "faceted" groove pattern 123. This supplemental heel pad 116 provides directional support and cushioning over this overlaid area of the extended heel pad 112 and is constructed as described above with respect to FIGS. 1A, 1B and 2. The supplemental heel pad 116 is affixed to the extended heel pad 112 by an adhesive or mechanical fastener.

The top surface of the base 102 defines an upwardly-extending portion or transverse arch support 138 that lies under the metatarsal head area of the foot. The upward extension of transverse arch support 138 pushes up a portion of the top sheet 101 that corresponds to the area of the transverse arch support 138. Transverse arch support 138 preferably lies under the second to fourth metatarsal heads. Transverse arch support 138 provides additional stability and cushioning to the forefoot and middle of the foot.

The stability cradle indentation area 105 is located in the midfoot and heel areas of the bottom surface of base 102. The stability cradle indentation area 105 extends from a medial edge approximate the medial border to a lateral edge approximate the lateral border of the base and from a distal edge slightly proximal of the forefoot pad indentation area 107 to a proximal edge approximate the heel end of the base. A medial portion of the distal edge is shaped to accommodate downward motion of the 1st metatarsal during toe off. Stability cradle 106 is shaped essentially the same as stability cradle indentation area 105 and has a base facing surface and a shoe facing surface. The base facing surface is secured to said stability cradle indentation area 105.

Stability cradle 106 has walls that extend up the medial and lateral sides of the midfoot and surround the rear of base 102 to provide support for the foot. Preferably, stability cradle 106 ranges from approximately 0.5 mm to 3 mm thick and the walls taper from approximately 3 mm to about 0.5 mm. The sides of stability cradle 106 are preferably higher on the medial side of the foot because of the higher loading.

Stability cradle 106 defines an extended heel pad opening 113 that extends from behind the $3^{rd}$ through $5^{th}$ metatarsal heads proximally to the back of the cuboid. Stability cradle 106 defines an extended heel pad opening 113 that extends through the heel area along the lateral side of the midfoot area and into the heel end. The extended heel pad 112 is shaped essentially the same as the extended heel pad opening 113 and is secured to the bottom surface of base 102 within the stability cradle indentation area 105 in a location that correlates to the extended heel pad opening 113 and allows the extended heel pad 112 to extend out through said extended heel pad opening 113.

In a preferred embodiment, base 102 is covered with top sheet 101, which is preferably a non-woven fabric layer with a low coefficient of friction so as to minimize the possibility of blisters. Preferably, top sheet 101 is made of a cooling fabric which contains a special low temperature jade obtained from a natural source. The form of jade in the fabric is a jadeite. In a preferred embodiment, the fabric is treated with an antibacterial agent, which in combination with a moisture barrier reduces odor causing bacteria and fungi.

Figure 8:
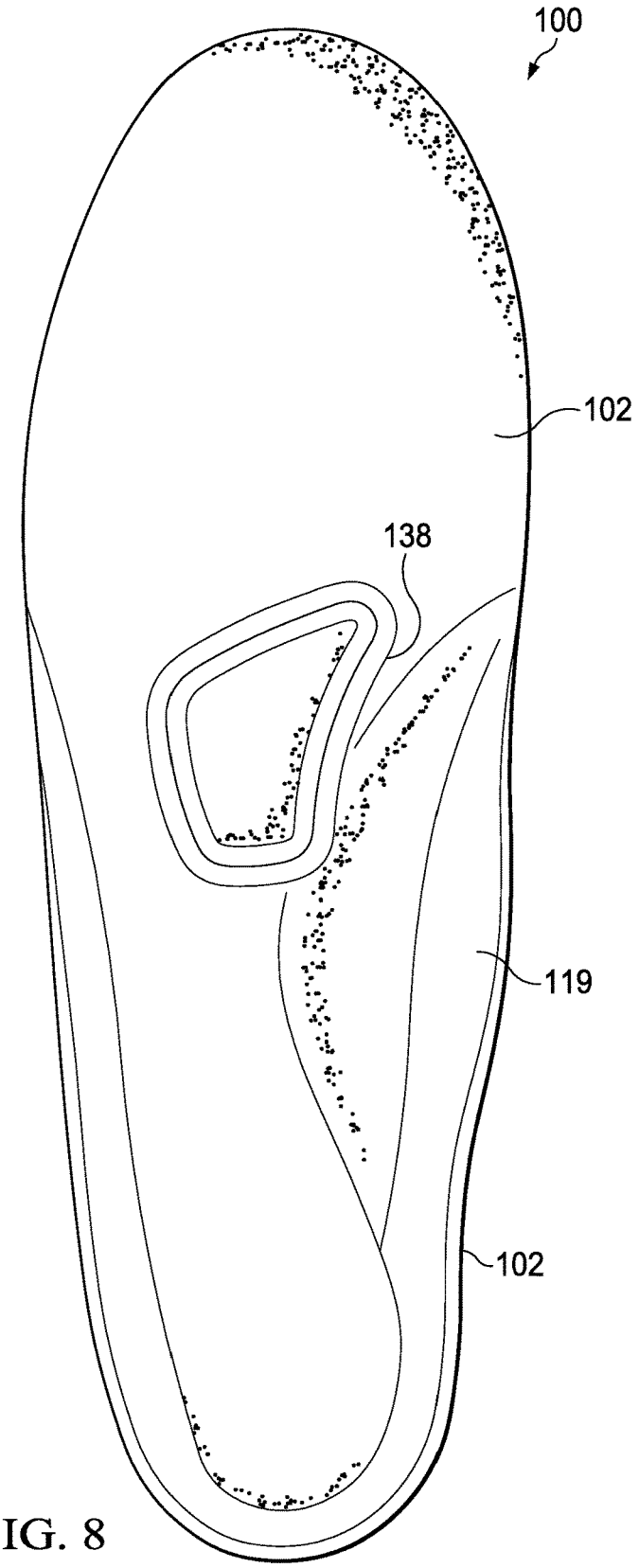
FIG. 8 is a medial (inner side) view of the insole.

FIG. 8 is a top view of the insole illustrating the insole 100 with the top sheet 101 removed to show the exposed base 102 and the exposed transverse arch support 138. The top surface of the base 102 defines an upwardly-extending portion or transverse arch support 138 that lies under the metatarsal head area of the foot. The upward extension of transverse arch support 138 pushes upwardly.

Transverse arch support 138 preferably lies under the second to fourth metatarsal heads. Transverse arch support 138 provides additional stability and cushioning to the forefoot and middle of the foot. In a preferred embodiment, base 102 also defines a longitudinal arch support 119 that extends upwardly along the medial side of the insole to provide extra cushion and support to the arch area of the foot.

Figure 9:
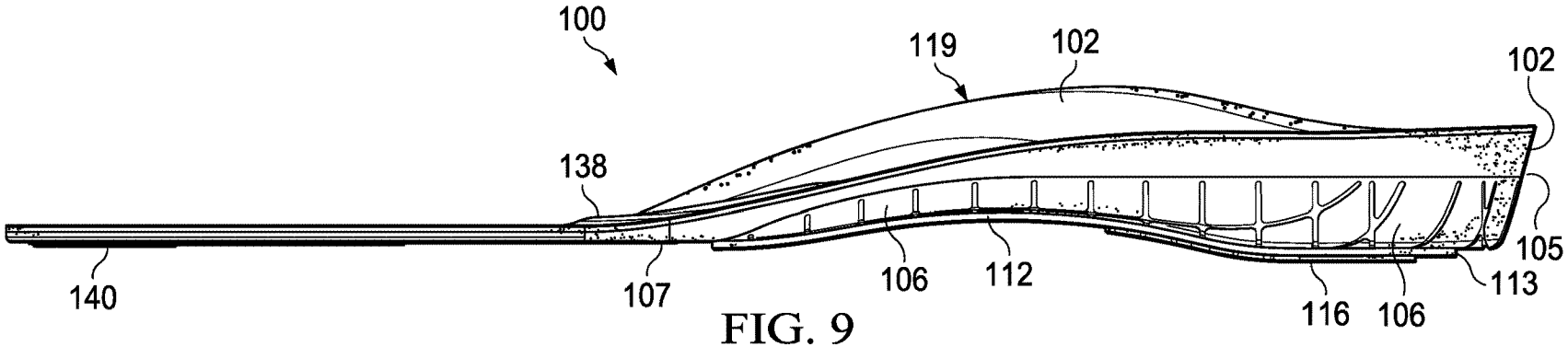
FIG. 9 is a lateral (outer side) view of the insole.

FIG. 9 illustrates a lateral side view of the insole 100 with the top sheet 101 removed to show the structures and components on the base 102. Insole 100 comprises a base 102 having a top surface and the base 102 also defines a longitudinal arch support 119 that extends upwardly along the medial side of the insole to provide extra cushion and support to the arch area of the foot. The bottom surface of base 102 defines a forefoot pad indentation area 107 in the forefoot area and a stability cradle indentation area 105 along the midfoot and heel areas.

Base 102 has a raised edge that wraps around the heel and extends partially along the sides of the foot such that the insole has a heel cup, which conforms to the natural shape of the foot. The height of the raised edge is generally lower and thicker on the lateral side of the insole and is lower and thinner on the medial side of the insole.

The forefoot pad indentation area 107 begins partially proximal from the toe pad 140 of the insole 100 near the distal ends of the proximal phalanges of the foot. The forefoot pad indentation area 107 extends rearward to about the 3rd through 5th metatarsal heads on a lateral portion and approximately halfway along the 1st and 2nd metatarsals on a medial portion. Preferably the forefoot pad indentation area 107 has a rear apex that lies between the 1st and 2nd metatarsals. A forefoot pad 108 is shaped essentially the same as forefoot pad indentation area and is secured therein.

The stability cradle indentation area 105 is located in the midfoot and heel areas of the bottom surface of base 102. The stability cradle indentation area 105 extends from a medial edge approximate the medial border to a lateral edge approximate the lateral border of the base and from a distal edge slightly proximal of the forefoot pad indentation area 107 to a proximal edge approximate the heel end of the base 102. A medial portion of the distal edge is shaped to accommodate downward motion of the 1st metatarsal during toe off. Stability cradle 106 is shaped essentially the same as stability cradle indentation area 105 and has a base facing surface and a shoe facing surface. The base facing surface is secured to said stability cradle indentation area 105.

Stability cradle 106 defines an extended heel pad opening 113 that extends from behind the $3^{rd}$ through $5^{th}$ metatarsal heads proximally to the back of the cuboid. An extended heel pad 112 is shaped essentially the same as the extended heel pad opening 113 and is secured to the bottom surface of base 102 within the stability cradle indentation area 105 in a location that correlates to the extended heel pad opening 113 and allows the extended heel pad 112 to extend out through said opening 113. Stability cradle 106 has walls that wrap up the sides and rear of base 102 to provide support for the foot. Preferably, stability cradle 106 ranges from approximately 0.5 mm to 3 mm thick and the walls taper from approximately 3 mm to about 0.5 mm. The sides of stability cradle 106 are preferably higher on the medial side of the foot because of the higher loading.

Supplemental heel pad 116 overlays onto a portion of the extended heel pad 112. This supplemental heel pad 116 provides directional support and cushioning over this overlaid area of the extended heel pad 112 and is constructed as described above with respect to FIGS. 1A, 1B and 2. The supplemental heel pad 116 is affixed to the extended heel pad 112 by an adhesive or mechanical fastener (e.g. hook and loop fastener).

Preferably, the top surface of the base 102 defines an upwardly-extending portion or transverse arch support 138 that lies under the metatarsal head area of the foot. The upward extension of transverse arch support 138 pushes upwardly. Transverse arch support 138 preferably lies under the second to fourth metatarsal heads. Transverse arch support 138 provides additional stability and cushioning to the forefoot and middle of the foot.

Figure 10:
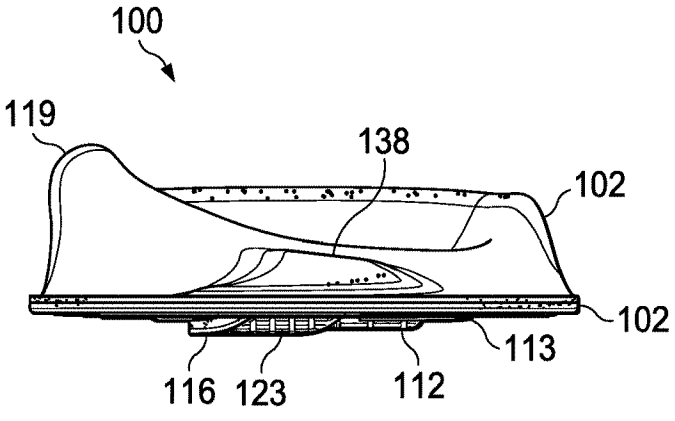
FIG. 10 is a front (proximal) view of the insole.

FIG. 10 illustrates the front view of the insole 100, and 11 illustrates a rear view of the insole 100—both without the top sheet 101 placed on top of the base 102. Insole 100 preferably comprises a base 102 having a top surface and an opposite bottom surface. Base 102 also defines a longitudinal arch support 119 that extends upwardly along the medial side of the insole to provide extra cushion and support to the arch area of the foot.

The bottom surface of base 102 defines a stability cradle indentation area 105 along the midfoot and heel areas. The bottom surface of base 102 also define one or more ribs or protrusions 132 that extend outwardly along the arch area. The stability cradle 106 preferably defines one or more rib-shaped openings 131. In a preferred embodiment, the rib-shaped openings 131 allow said ribs 132 of base 102 to extend therethrough.

Preferably, base 102 is molded so that the ribs 132 project into rib-shaped openings 131 so that the ribs 132 are approximately flush with the outer surface of stability cradle 106 and mechanically lock stability cradle 106 and base 102 together. Advantageously, the ribs 132 are also able to bulge through rib-shaped openings 131 when base 102 is compressed (e.g., while walking or running) to provide additional cushioning and support to the arch of the foot.

The rib-shaped openings 131 allow the stability cradle 106 to be more flexible in the arch area compared to the rest of the stability cradle 106. In an alternate embodiment, stability cradle 106 defines one or more protruding ribs instead of openings. The protruding ribs extend outwardly along the arch area. The protruding ribs are longer around the cuneiforms and gradually shorter distally and proximally from the cuneiforms creating a parabolic-like overall shape. The protruding ribs extend outward approximately 0.50 mm. The ribs 132 are preferably longer around the cuneiforms and gradually shorter distally and proximally from the cuneiforms creating a parabolic-like overall shape. An alternate embodiment has the ribs or protrusions defined by the stability cradle 106 and extending outwardly from the stability cradle 106 in the arch area.

Base 102 has a raised edge that extends upwardly around the medial and lateral midfoot area and wraps around the heel area to surround the insole heel cup, which conforms to the natural shape of the foot. The height of the raised edge is generally lower and thinner on the lateral side of the insole and is higher and thicker on the medial side of the insole.

Supplemental heel pad 116 overlays onto a portion of the extended heel pad 112 on the medial side of the heel area and has a square "faceted" groove pattern 123. This supplemental heel pad 116 provides directional support and cushioning over this overlaid area of the extended heel pad 112 and is constructed as described above with respect to FIGS. 1A, 1B and 2. The supplemental heel pad 116 is affixed to the extended heel pad 112 by an adhesive or mechanical fastener (e.g. hook and loop fastener).

The top surface of the base defines an upwardly-extending portion or transverse arch support 138 that lies under the metatarsal head area of the foot. The upward extension of transverse arch support 138 pushes up a portion of the top sheet 101 that corresponds to the area of the transverse arch support 138. Transverse arch support 138 preferably lies under the second to fourth metatarsal heads. Transverse arch support 138 provides additional stability and cushioning to the forefoot and middle of the foot.

The stability cradle indentation area 105 is located in the midfoot and heel areas of the bottom surface of base 102. The stability cradle indentation area 105 extends from a medial edge approximate the medial border to a lateral edge approximate the lateral border of the base and from a distal edge slightly proximal of the forefoot indentation area to a proximal edge approximate the heel end of the base. A medial portion of the distal edge is shaped to accommodate downward motion of the 1st metatarsal during toe off. Stability cradle 106 is shaped essentially the same as stability cradle indentation area 105 and has a base facing surface and a shoe facing surface. The base facing surface is secured to said stability cradle indentation area 105.

Stability cradle 106 has walls that wrap up the sides and rear of base 102 to provide support for the foot. Preferably, stability cradle 106 ranges from approximately 0.5 mm to 3 mm thick and the walls taper from approximately 3 mm to about 0.5 mm. The sides of stability cradle 106 are preferably higher on the medial side of the foot because of the higher loading.

Stability cradle 106 defines an extended heel pad opening 113 that extends from behind the $3^{rd}$ through $5^{th}$ metatarsal heads proximally to the back of the heel area cuboid from below along the lateral side of the insole 100.

Stability cradle 106 defines an extended heel pad opening 113 that extends through the heel area along the lateral side of the midfoot area and into the heel end. The extended heel pad 112 is shaped essentially the same as the extended heel pad opening 113 and is secured to the bottom surface of base 102 within the stability cradle indentation area 105 in a location that correlates to the extended heel pad opening 113 and allows the extended heel pad 112 to extend out through said extended heel pad opening 113.

For a men's size 11-12 insole, the width of the forefoot pad from the medial to lateral side is about 85 to 95 mm. The height is about 100 to 110 mm. The depth is about 0.95 to 1.50 mm. It is desirable to minimize the total weight of the insoles by selection of materials working with the structural features of the insole. It is desirable that the total weight of the preferred embodiment of the insole (men's size 10/11) be about 4.0 ounces. It is desirable that the total weight of an alternate embodiment of the insole be about 5.0 to 6.0 ounces for a men's size 10/11 and about 6.5 to 7.5 ounces for a men's size 12/13. Other sizes will be proportional. Using the open-cell designs will provide for a lighter insole.

In a first preferred embodiment of the present invention, the various components of an insole which are secured to base 102 in the indentation areas defined by base 102 on the bottom surface are permanently affixed to base 102 using an appropriate means such as an adhesive. The components are secured during the molding process using techniques known in the art of molding insoles.

The indentation areas are also lined with a cloth having a base surface and a pad surface, secured to said base 102 along said base surface and said pad along said pad surface. Alternatively, a cloth is secured to pad and then the composite structure secured to the indentation area.

Some shoes may slightly differ in size on the inner part of the shoe. Some shoes may also provide extra padding along the inner sides, front or back of the shoe that alter the actual space provided for the foot and/or an insole on the inner part of the shoe. Base 102 may have sizing guides 150 that allow a user to shorten the length of the insole for proper fit within the shoe, sizing guides 150 provide various cutting guide lines that the user would cut along, preferably with scissors.

An improved insole 100 has been disclosed. It will be readily apparent that the illustrative embodiments of an insole thus disclosed may be useful in cushioning the foot and controlling pronation during activities such as hiking, backpacking, and the like. However, one will understand that the components of the insole system may be modified to accommodate other activities or to control other kinds of foot motion. Thus, the description provided herein, including the presentation of specific thicknesses, materials, and properties of the insole components, is provided for purposes of illustration only and not of limitation, and that the invention is limited only by the appended claims.

What is claimed is:

1. An insole having a top surface for contacting a user's foot and a bottom surface for contacting the bottom interior of a user's shoe, comprising:

a. a base, said base having a base top side and a base bottom side, said base having a heel end, a toe end, a medial side defining an inner arch area and a lateral side defining an outer border area, said medial and said lateral sides extending from said heel end to said toe end along said arch area and said outer border area of said insole, respectively, and said base bottom side of said base defining a toe area, a forefoot area, a stability area and a heel area;

b. a stability cradle made of semi-rigid material, said stability cradle having a cradle top side and a cradle bottom side and a single extended heel pad opening extending from said cradle top side to said cradle bottom side along the lateral side of the insole from the midfoot area to the heel area and from the lateral side to the medial side in the heel area, said cradle top side affixed to a stability cradle indentation area of said base bottom side of said base;

c. a forefoot pad located in a forefoot indentation area between said midfoot and said toe areas of the insole;

d. a continuous extended heel pad having a top surface and a bottom surface and extending along the lateral side of the insole from the midfoot area to the heel area, said extended heel pad having said top surface affixed to said base bottom surface and said bottom surface extending through the single extended heel pad opening in said stability cradle, the continuous extended heel pad corresponding in shape to said single extended heel pad opening; and e. a supplemental heel pad having a top surface and a bottom surface, said top surface being affixed and positioned over a portion of the extended heel pad in the heel pad area of the insole that is extending through the single extended heel pad opening in said stability cradle.

2. The insole of claim 1, wherein said insole further comprises a top sheet having a foot contacting surface and an opposite surface that is adhered to said base top side of the base.

3. The insole of claim 1, wherein said stability cradle, said extended heel pad and said supplemental heel pad provides control of the amount or rate of pronation of a user's foot.

4. The insole of claim 1, wherein said forefoot pod has a square faceted surface for contact to the bottom interior of the user's insole.

5. The insole of claim 1, wherein said supplemental heel pad is made of a firmer material than said extended heel pad.

6. The insole of claim 1, wherein said supplemental heel pad is made of a softer material than said extended heel pad.

7. The insole of claim 1, wherein said supplemental heel pad is made of a material of the same firmness of said extended heel pad.

8. The insole of claim 1 wherein the stability cradle is made of material with sufficient rigidity to support the medial side of a user's foot and assist in the control of foot pronation.

9. The insole of claim 1 wherein the stability cradle is made of material that has a durometer of about Shore A 90.

10. The insole of claim 1 wherein the stability cradle is made of material that has side walls that lie adjacent the lateral and medial sides of said insole.

11. The insole of claim 10 wherein the stability cradle has walls that have a thickness ranging from 0.5 mm to 3 mm thick.

12. The insole of claim 1 wherein the stability cradle is made of polypropylene.

13. The insole of claim 1 wherein the stability cradle has a length essentially equivalent to the length from the calcaneus through the metatarsal joints of a user's foot for which said insole is designed to be used.

14. An insole for use in a shoe having a top side for contacting a user's foot and a bottom side for contacting the bottom interior surface of a user's shoe, comprising:

a. a base, said base having a base top surface and a base bottom surface, said base having a heel end, a toe end, a medial border and a lateral border, said medial and lateral borders extending from said heel end to said toe end along the medial and lateral sides of the insole, respectively, said base bottom surface defining:

(i) a forefoot area extending from the toe end of said base to a location adapted to correspond to an area behind a metatarsal head area of the feet, (ii) a midfoot area adapted to extend from the metatarsal head area of the feet to an edge that lies forward of the calcaneus of the foot, (iii) a heel area that extends from said midfoot area to said heel end, (iv) a forefoot pad indentation area located in said forefoot area, and adapted to extend from under the hallux of the foot from near the distal end of the base proximally to the front of the first metatarsal head, and (v) a stability cradle indentation area located essentially along the midfoot and heel areas of the insole, b. a continuous extended heel pad located in said lateral midfoot area that extends along the lateral side of the insole from the midfoot area to the heel area and from the lateral side to the medial side in the heel area, said extended heel pad being affixed to said base bottom surface of said base;

c. a stability cradle made of semi-rigid material and secured to said stability cradle indentation area of said base bottom side, said stability cradle having rib openings and an extended heel pad opening that allows the extended heel pad to extend there through;

d. a forefoot pad secured to said forefoot pad indentation area, said forefoot pad adapted to extend laterally and proximally under the lesser metatarsal heads of the foot to beneath the greater metatarsals; and e. a supplemental heel pad affixed to said extended heel pad and located over a portion of the extended heel pad on the medial side of said heel area.

15. The insole of claim 14 wherein the supplemental heel pad is made of a firmer material than the material of the extended heel pad.

16. The insole of claim 14, wherein the firmness of the supplemental heel pad is in the range of Shore C 45-50 and the firmness of the extended heel pad is approximately Shore C 60.

17. The insole of claim 14, wherein the firmness of the supplemental heel pad is in the range of Shore C 50-55 and the firmness of the extended heel pad is in the range of about Shore C 65-70.

18. The insole of claim 14, wherein the firmness of the supplemental heel pad and the extended heel pad is selected to control a rate of pronation.

19. The insole of claim 14, wherein the firmness of the supplemental heel pad and the extended heel pad is selected based on a type of activity for which the insole is designed.

20. The insole of claim 14, wherein the stability cradle is shaped to enable flexing of the first metatarsal during toe off.

21. A method of making an insole to control the motion of a user's foot in a shoe, the method comprising:

providing a base having a base top surface and a base bottom surface, said base having a heel end, a toe end, a medial border and a lateral border, said medial and said lateral borders extending from said heel end to said toe end, said base bottom surface defining:

(a) a forefoot area extending from the toe end of said base to a location adapted to correspond to an area behind a metatarsal head area of the feet, (b) a midfoot area adapted to extend from the metatarsal head area to an edge that lies forward of the calcaneus of the foot, (c) a heel area that extends from said midfoot area to said heel end;

(d) a stability cradle indentation area; and, (e) a forefoot indentation area;

coupling a stability cradle to the base, said stability cradle being made of semi-rigid material and said stability cradle secured to said stability cradle indentation area of said base bottom side of said base; said stability cradle indentation area located essentially along the midfoot and heel areas of the base bottom surface, coupling continuous extended heel pad to the base bottom surface of the base, said continuous extended heel pad extending through an extended heel pad opening in said stability cradle;

coupling a forefoot pad to the base, said forefoot pad adapted to extend laterally and proximally under the lesser metatarsal heads of the foot to beneath the greater metatarsal and affixed to said forefoot indentation area; and, coupling a supplemental heel pad to the extended heel pad, said supplemental heel pad laying over a portion of said extended heel pad on the medial side of the heel area.

22. The method of claim 21, wherein the supplemental heel pad is made of a firmer material than the material of the extended heel pad.

23. The method of claim 21, wherein the firmness of the supplemental heel pad is in the range of Shore C 45-50 and the firmness of the extended heel pad is approximately Shore C 60.

24. The method of claim 21, wherein the firmness of the supplemental heel pad is in the range of Shore C 50-55 and the firmness of the extended heel pad is in the range of about Shore C 65-70.

25. The method of claim 21, wherein the supplemental heel pad is made of a firmer material than the material of the extended heel pad.

26. The method of claim 21, wherein the firmness of the supplemental heel pad and extended heel pad is selected to control the rate of pronation.

27. The method of claim 21, wherein the firmness of the supplemental heel pad and extended heel pad is selected based on the type of activity for which the insole is designed.

28. The method of claim 21, wherein the stability cradle is shaped to enable flexing of the first metatarsal during toe off.

29. The method of claim 21, wherein the base comprises an EVA foam material.

30. The method of claim 21, wherein said stability cradle has ribs that are vertically aligned in the sidewall of the medial arch area.

* * * * *